US010640982B1

(12) United States Patent
Bulla

(10) Patent No.: US 10,640,982 B1
(45) Date of Patent: May 5, 2020

(54) PROTECTIVE GUTTER DEVICES, METHODS, AND ASSEMBLIES

(71) Applicant: Gregory L. Bulla, New Bern, NC (US)

(72) Inventor: Gregory L. Bulla, New Bern, NC (US)

( * ) Notice: Subject to any disclaimer, the term of this patent is extended or adjusted under 35 U.S.C. 154(b) by 0 days.

(21) Appl. No.: 15/811,893

(22) Filed: Nov. 14, 2017

Related U.S. Application Data

(60) Provisional application No. 62/422,325, filed on Nov. 15, 2016.

(51) Int. Cl.
*E04D 13/064* (2006.01)
*E04D 13/068* (2006.01)

(52) U.S. Cl.
CPC ..... *E04D 13/0643* (2013.01); *E04D 13/068* (2013.01)

(58) Field of Classification Search
CPC . E04D 12/0643; E04D 12/068; E04D 13/064; E04D 13/0641
USPC ..... 52/11–15; 137/357, 358, 615; 138/41, 138/109; 174/39; 210/162, 170.03; 404/2–5; 405/119–121; D23/267
See application file for complete search history.

(56) References Cited

U.S. PATENT DOCUMENTS 702,156 A * 6/1902 Rye ..... E04D 13/064 405/120
5,678,359 A * 10/1997 Turner ..... E04D 13/064 52/105
6,041,555 A * 3/2000 Alpi ..... E04D 13/08 52/11
6,560,933 B2 * 5/2003 Richardson ..... E04D 13/064 52/11
6,883,760 B2 * 4/2005 Seise, Jr. ..... E04D 13/076 210/474
7,610,722 B1 * 11/2009 Carroll ..... E04D 13/064 138/165
7,765,743 B2 * 8/2010 Guilford ..... E04D 13/076 210/474
8,720,122 B1 * 5/2014 Feldhaus ..... E04D 13/076 52/12
8,763,310 B2 * 7/2014 Dehart, Sr. ..... E04D 13/0643 52/11
8,844,208 B1 * 9/2014 Feldhaus ..... E04D 13/076 52/12
D718,847 S * 12/2014 Creighton Haley ..... D23/267
9,062,460 B2 6/2015 Dehart, Sr. ..... E04D 13/0643
9,115,497 B2 * 8/2015 Morris ..... E04D 13/0767
9,771,720 B2 * 9/2017 Martin ..... E04D 13/064
9,879,429 B2 * 1/2018 Joly, Jr. ..... E04D 13/0643
2005/0279036 A1 * 12/2005 Brochu ..... E04D 13/0643 52/287.1
2006/0225368 A1 * 10/2006 Roe ..... E04D 13/064 52/12
2009/0107053 A1 * 4/2009 Guilford ..... E04D 13/0643 52/12

(Continued)

*Primary Examiner* — Joshua J Michener
*Assistant Examiner* — James J Buckle, Jr.
(74) *Attorney, Agent, or Firm* — MacCord Mason PLLC

(57) ABSTRACT

A gutter device may be considered a gutter extension. A gutter extension may include an extension attaching to a gutter system for a facility and projecting away from a back wall. The extension may include at least two extension front walls and a bottom. The extension front walls adjoin with a front gutter wall. Gutter devices, systems, assemblies, kits and methods are shown and described and considered within the scope of the present disclosure.

9 Claims, 39 Drawing Sheets

(56) References Cited

U.S. PATENT DOCUMENTS

| | | | | |
|---|---|---|---|---|
| 2014/0047779 | A1* | 2/2014 | Dehart, Sr. | E04D 13/0643 52/11 |
| 2015/0292210 | A1* | 10/2015 | Haley | E04D 13/0641 52/12 |
| 2015/0300024 | A1* | 10/2015 | Joly, Jr. | E04D 13/0643 52/13 |
| 2016/0060870 | A1* | 3/2016 | Martin | E04D 13/064 52/12 |

* cited by examiner

PROTECTIVE GUTTER DEVICES, METHODS, AND ASSEMBLIES

This application claims priority to U.S. provisional application 62/422,325, filed Nov. 15, 2016, which is incorporated herein by reference its entirety.

FIELD OF THE TECHNOLOGY

The present disclosure relates generally to gutters, and more particularly to improved gutter extension devices, methods, systems and assemblies.

BACKGROUND

It is desirable to provide gutters for water direction and control on buildings. Currently, gutters are typically installed on new construction and maintained on existing facilities, be it residential and/or commercial structures.

In some instances, Applicant realizes that the gutters conventionally used on buildings are associated with problems, such as, by way of example, not carrying and/or directing the water flow from the roofing of the building, especially during heavy water flow situations. In some examples, the angles of the roof and/or building structure may accelerate or intensify the water flow, situations that conventional gutters may not be equipped to properly handle, exposing the building to conditions prone to cause damage to the building structures. Water from the roof and overflowing past a gutter can gather around the base of a structure and cause foundation damage, weaken structures and accelerate environmental impacts.

Often in heavy water flow situations, water is directed by the roofline to valleys from peaks in the roof, such that water converges and accelerates as it nears the edge of the roofing. The water flow may be so heavy and/or gained acceleration to the point it skates across the top of conventional gutter systems and/or is not contained by the gutter. Attempts have been made to address this problem in the art by way of adding baffles to the gutter, adding a wall as a water stop and adding channels in attempts to direct water flow. A concern is an economically feasible option that addresses the gutter deficiencies efficiently and effectively, especially where retrofits to existing structures are concerned. Applicant also realized that a gutter system, especially any retrofit, should take into consideration and not be detrimental to the aesthetics of the structure. Applicant realized the shortcomings of the previous attempts to address the challenges with gutter systems.

Therefore, Applicants desire alternative cost-effective, improved devices, systems, kits, assemblies and methods that are useful and provide an improved gutter for retaining and directing water, while maintaining an aesthetically pleasing look that may match building materials.

SUMMARY

In accordance with the present disclosure, gutter devices, assemblies, kits and methods are provided for protecting buildings in an economical and aesthetically pleasing way, and the like. This disclosure provides improved gutter devices, system, kits, assemblies and methods that are convenient, efficient, and more durable for the building owner.

In one embodiment of the disclosure is a gutter extension including an extended face, at least two front walls, and a bottom. In some examples, the extended face projects outward away from a back wall and past a linear plane formed by an outer portion of an adjoining gutter. The gutter extension may be an insert.

In some examples, the extension may include gutter arms on each side of the extended face. The extended face may include a first front wall and a second front wall. The first front wall and the second front wall may interface to form a front corner. The first front wall and the second front wall may be substantially perpendicular to each other. The first front wall and the second front wall may interface at the front corner to form a substantially 90 degree angle at the front corner. The first front wall and the second front wall may intersect substantially perpendicularly with a first gutter arm and a second gutter arm, respectively. The first front wall and the second front wall may interface with a first gutter arm and a second gutter arm, respectively, to form a substantially 90 degree angle at each gutter arm and wall interface. The first front wall and second front wall may interface on one side with a first gutter arm and include an interface with an end cap on the other front wall. An end cap may be seal the end of the gutter to prevent water passage in places where the gutter terminates.

In some examples, the extension may include a back wall. The back wall may include a first portion and a second portion separated by a back corner.

Embodiments may include that the extension forms a corner of a gutter system. The extension may be a corner extension having a front corner diagonally opposed to a back corner. The front corner may project outward from the back corner by at least 10 inches. In some examples, the front corner projects outward from the back corner by at least 14 inches. Still in other embodiments, an area between the front corner and the back corner is at least double that of an area between a front wall and a back corner of a standard gutter back. The front corner may project outward from the back corner by more than 10 inches, and in other embodiments by less than 10 inches.

In some examples, the front corner extends outward further away from the back corner than the front wall and the back wall.

The extension may be a gutter system. The gutter may include an extension cover.

The extension may be a box insert. The box insert may be substantially square or may take on other shapes.

Still in other embodiments, the box insert may include a front corner diagonally opposed to a back corner. A first back wall portion and a second back wall portion may each have ends with openings that are structured to adjoin with a gutter system.

Examples also include where an extension is a partial insert that creates an extended face with a substantially 90 degree angle forming a front corner between two adjoining portions of a gutter system.

The extension, in certain examples, includes a third wall between said at least two front walls. The third wall, in one example, is substantially parallel with a back wall. In other examples, the third wall may be a radius extending from the first wall and second wall. The first wall and the second wall may be substantially parallel to each other and the first wall and second wall each have an end that intersects substantially perpendicularly at the end with said third wall. The first wall and the second wall each may have a second end that intersects substantially perpendicularly with a front wall. The first wall and the second wall may be non-parallel to the front wall and the back wall.

The gutter front wall on each side of the extended face may be in the same linear plane. The first wall and the second wall may extend outward from the linear plane and interface with the third wall to secure said the third wall in a parallel but separate linear plane.

The gutter extension, in these examples, may be a partial insert. The gutter extension may include gutter arms.

The gutter extension may include a radius front with a curved portion interfacing with a gutter on each radius end.

The inventions of the present disclosure may be considered a method for a gutter extension and/or for directing water from a roof by way of any of the embodiments disclosed, a kit of a gutter extension, and/or a system for a gutter extension.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
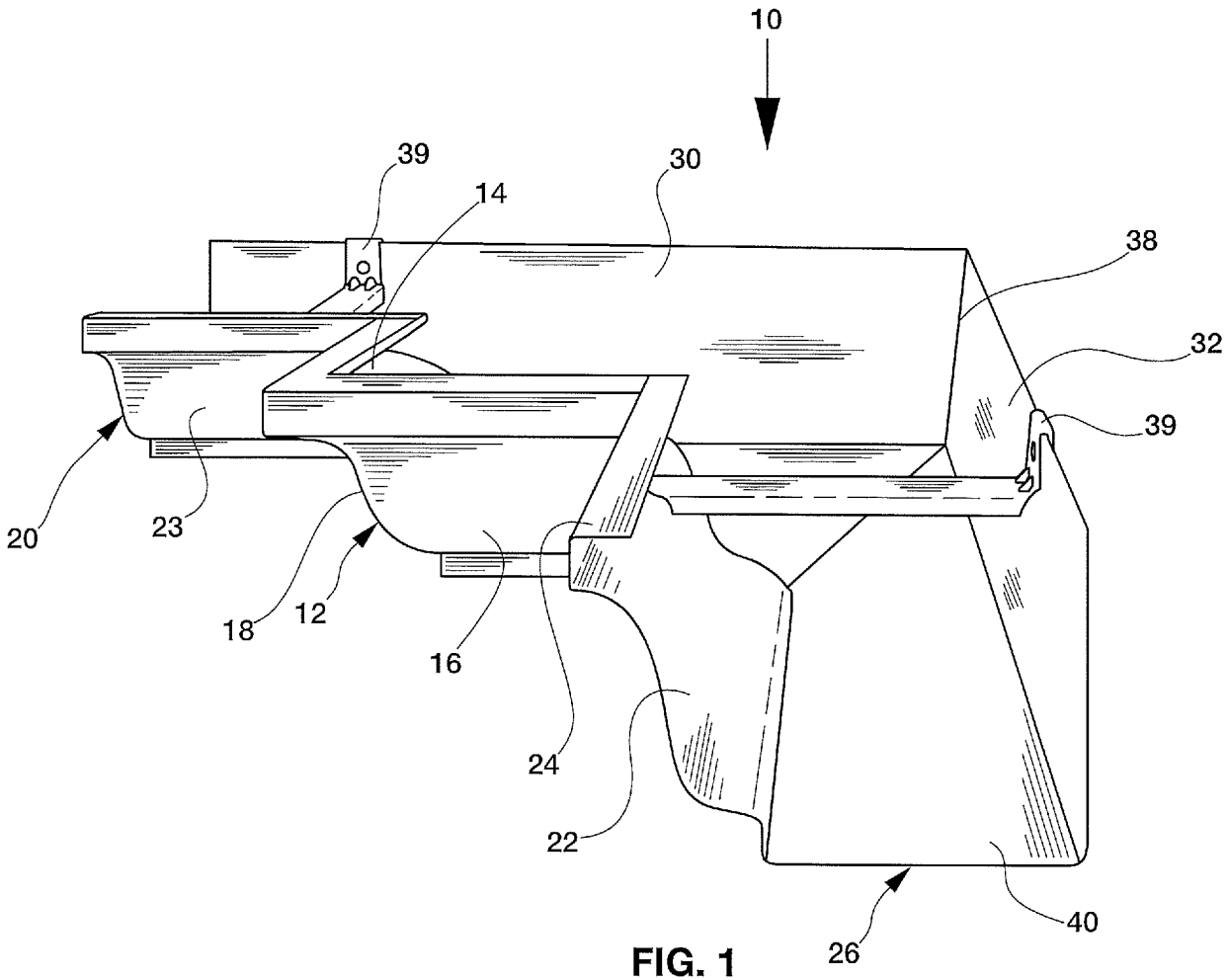
FIG. 1 is a perspective side view of one example of a gutter corner extension of the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any invention thereto. In one embodiment, a gutter extension 10 includes an extended face 12, at least two front extension walls 14, 16, and a bottom 40. In some examples, the extended face 12 projects outward away from a back wall.

Figure 1A:
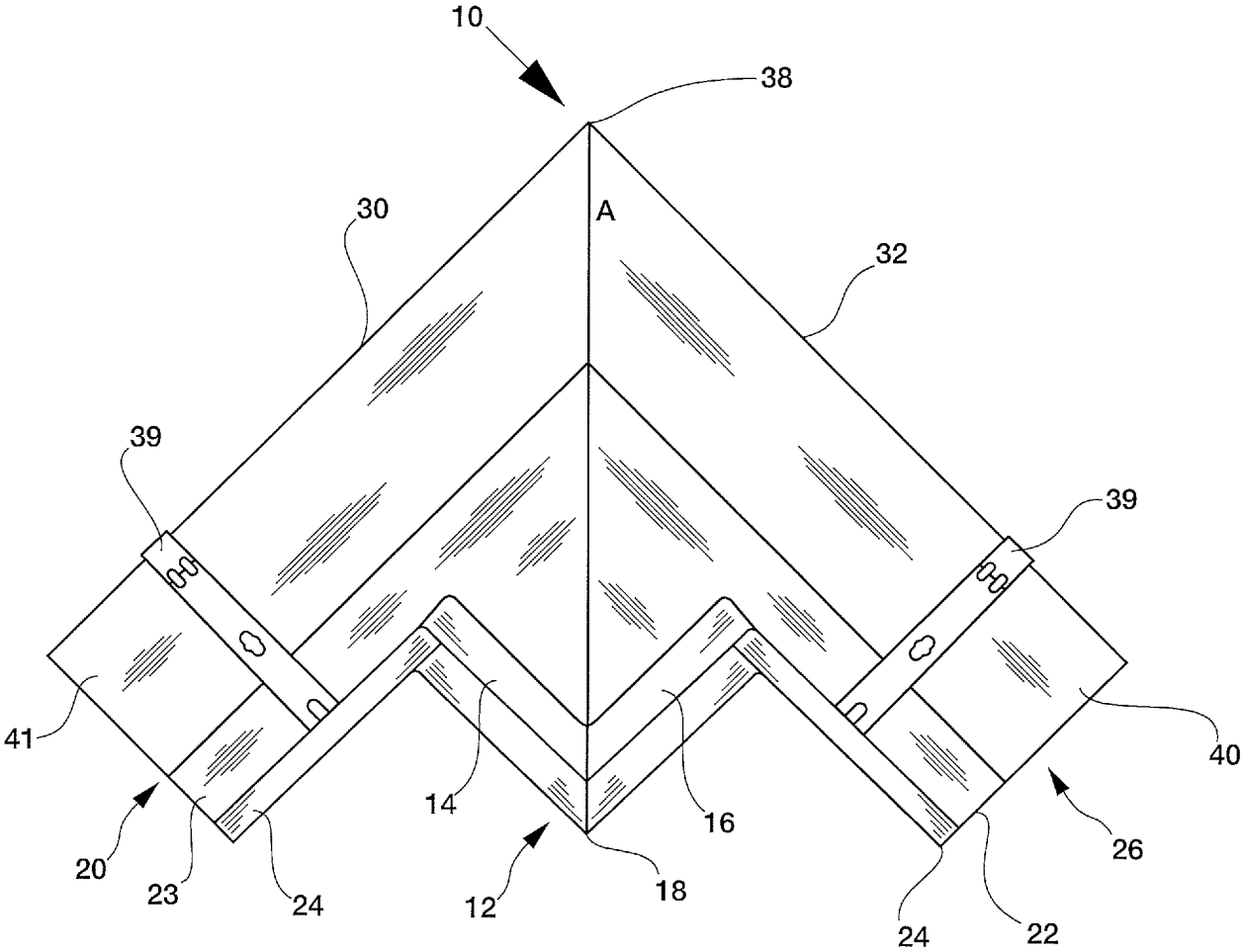
FIG. 1A is a top view of one embodiment of a gutter corner extension according to FIG. 1.
Figure 1B:
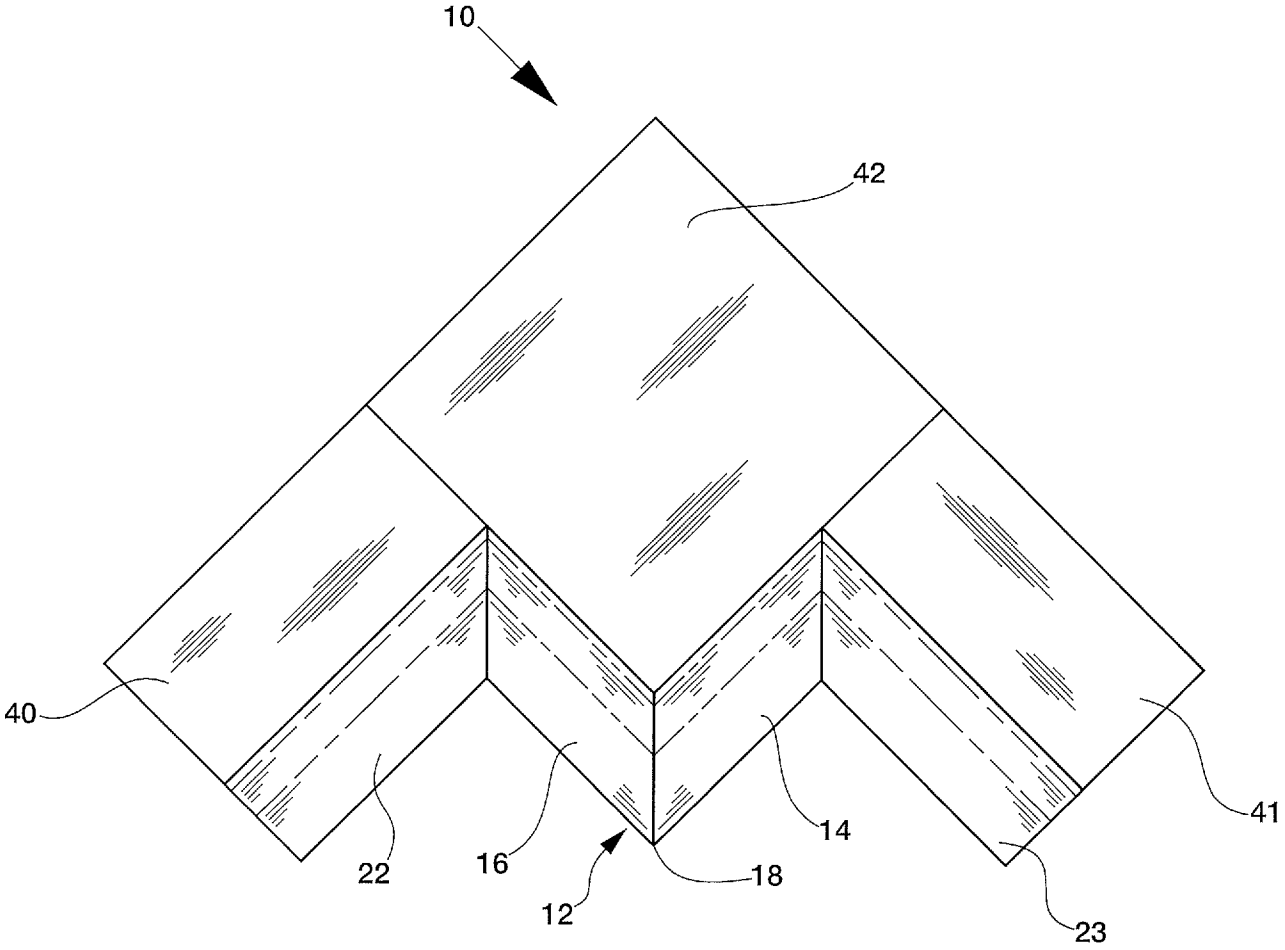
FIG. 1B is a bottom view of one embodiment of a gutter corner extension according to FIG. 1.
Figure 1C:
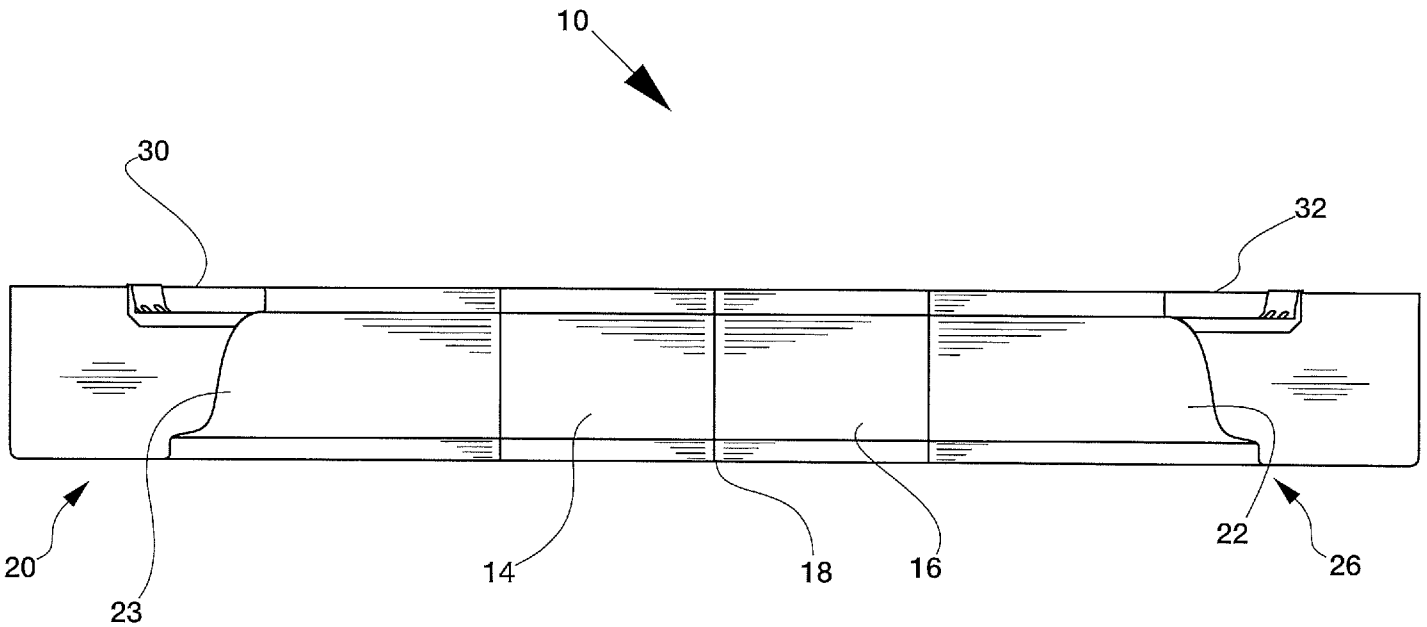
FIG. 1C is a front view of one embodiment of a gutter corner extension according to FIG. 1.
Figure 1D:
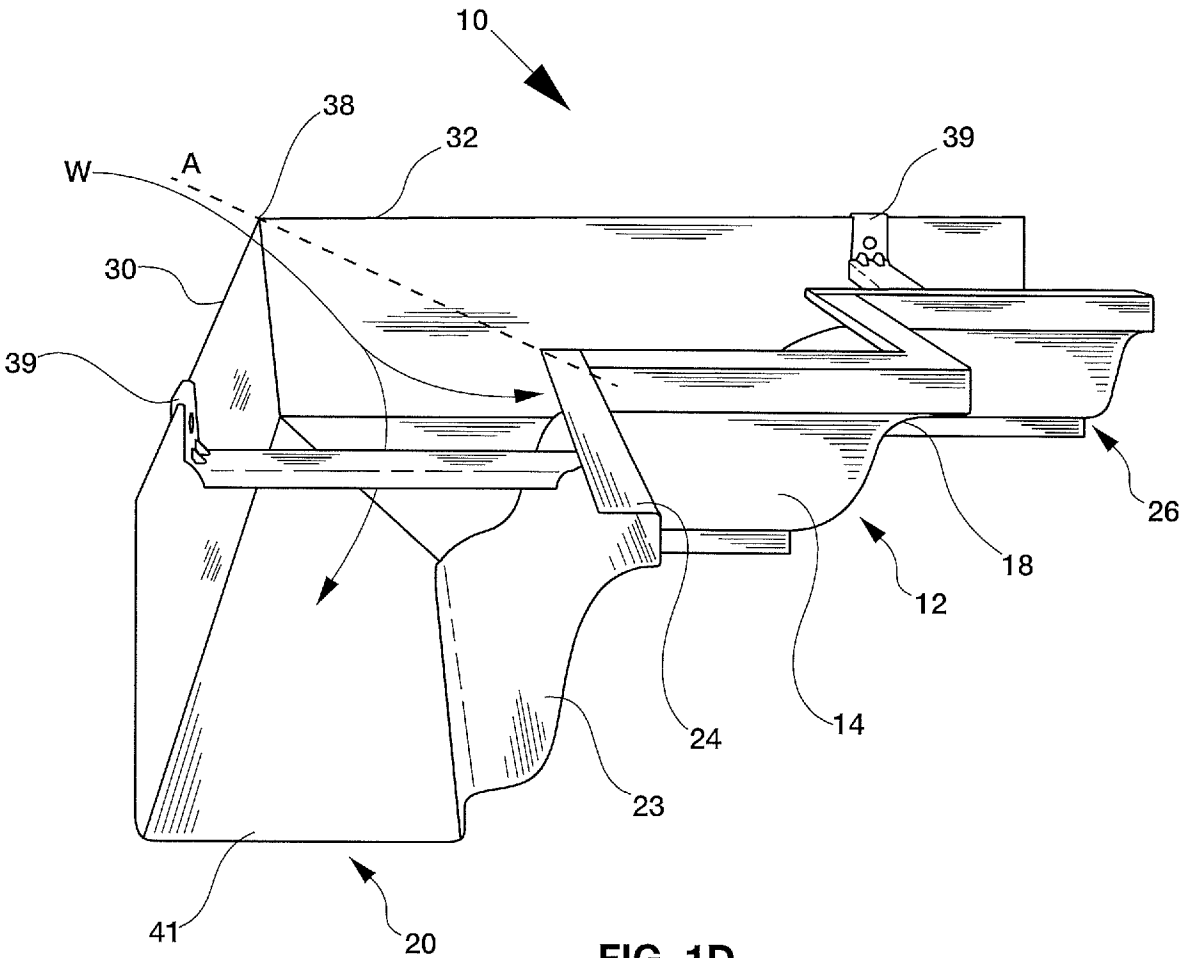
FIG. 1D is a perspective side view of one example of the other side of the gutter corner extension of FIG. 1.
Figure 1E:
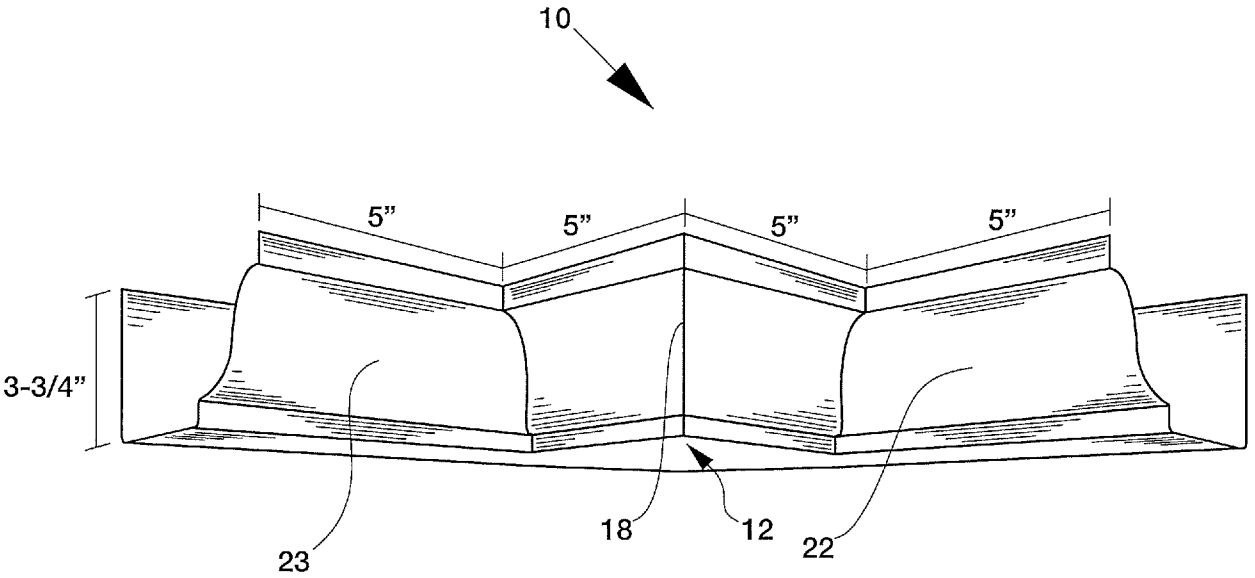
FIG. 1E is a perspective front view of one example of the gutter corner extension of FIG. 1.
Figure 1F:
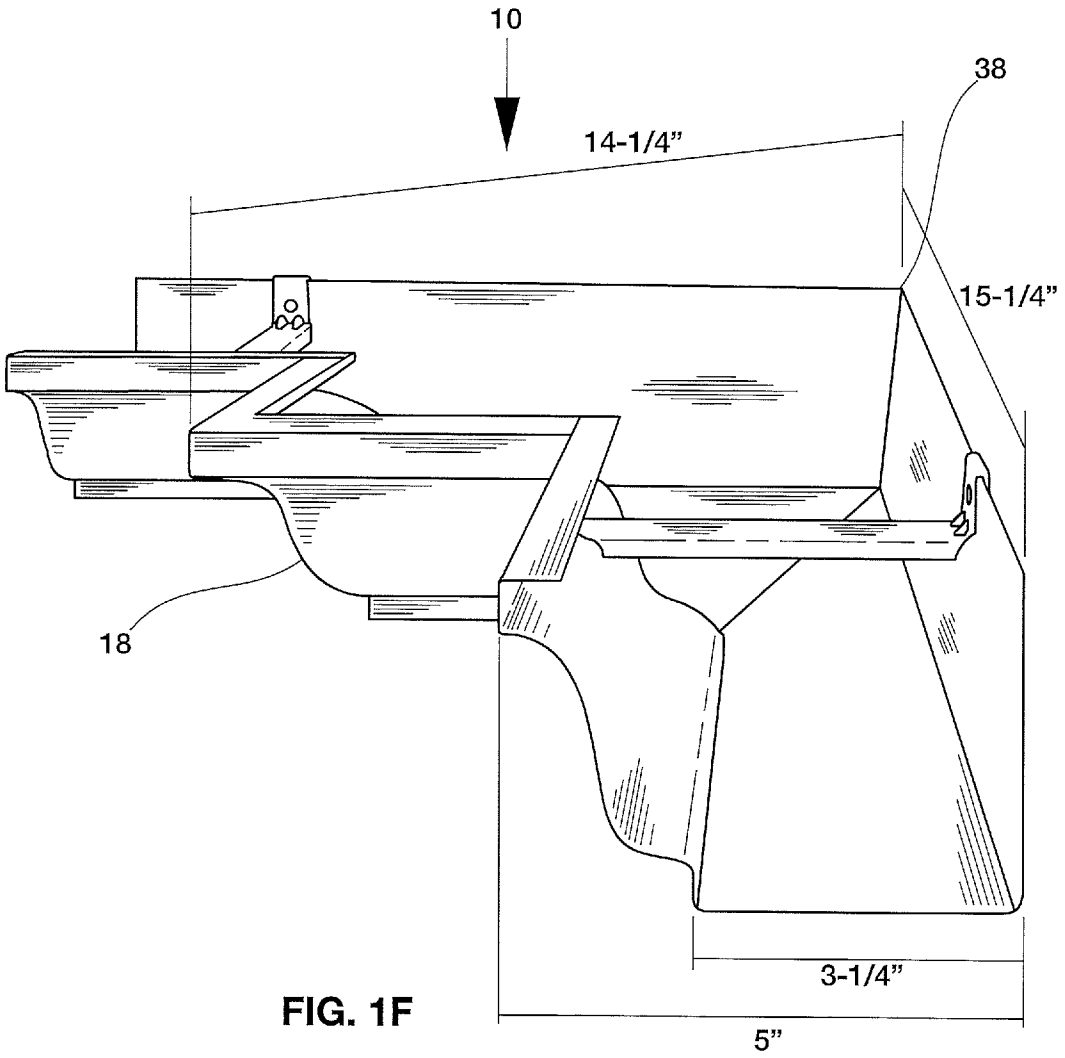
FIG. 1F is a perspective side view of one example of the gutter corner extension of FIG. 1.

FIGS. 1-1D show examples of a gutter extension 12 for a corner of a gutter system. In this example, the back wall may include a first portion 30 and a second portion 32 coming together to form a back corner 38. In some examples the extension may be considered a corner gutter extension.

In some examples, the extension may include gutter arms 20, 26 on each side of the extended face 12. The gutter arms may include back walls 30, 32, bottoms 40, 41 and/or gutter from walls 22, 23.

The extended face 12 may include a first front wall 14 and a second front wall 16. The first front wall 14 and the second front wall 16 may interface to form a front corner 18. The first front wall 14 and second front wall 16 may be substantially perpendicular to each other. The first front wall 14 and the second front wall 16 may interface at the front corner 18 to form a substantially 90 degree angle at the front corner 23. The first front wall 14 and the second front wall 16 may intersect substantially perpendicularly with a first gutter arm 20 and a second gutter arm 26, respectively. The first front wall 14 and the second front wall 16 may interface with a first gutter arm 20 and a second gutter arm 26, respectively, to form a substantially 90 degree angle at each gutter arm and wall interface. A substantially 90 degree angle may be formed at the intersection of the first front wall 14 and second front wall 16 and also at the intersection of each wall 14, 16 with its respective gutter arm 20, 26.

The extension 10 may include an extended face 12 and be a part of a gutter system. The extension 10 may be a corner extension having a front corner 18 diagonally opposed to a back corner 38. In some examples, the front corner 12 extends outward further away from the back corner 38 than does the first front wall 14 and/or the second front wall 16. By way of example, the front corner 18 may project outward from the back corner 38 and be formed by the intersection of first front wall 14 and second wall 16 such that the intersection of the walls is the furthest point away from the back corner 38 (see A in FIGS. 1A and 1D). In some examples, the front corner 18 is separated from the back corner 38 by at least 10 inches. In some examples, the front corner 12 projects outward from the back corner 38 by at least 14 inches. Still in other embodiments, an area between the front corner 14 and the back corner 38 is at least double that of an area A between a front wall and a back corner of a standard gutter back (about 7 inches in this example).

The front corner 12, in some embodiments may project away from the back corner by at least 14 inches. In other embodiments, the front corner may project outwardly away from the back corner 38 within a range of between 14 inches and 18 inches. Still in other embodiments, the front corner 12 may project outwardly away from the back corner by more than 15 inches when measured diagonally from corner to corner. In some examples, the bottom of the gutter arms 20, 26 may have a width of substantially between 3 inches and 6 inches, and/or any width in between. The top of the gutter arms 20, 26 may include a greater width than the bottom, by way of example, between a range of 5 inches and 8 inches.

The extended face 12 projecting away from the back of the gutter as described herein, creates a greater area for water to gather and prevents water from skating over the top of the gutter. Additionally, the larger extension area prevents the clogging of the gutter system at the extension location, such areas are otherwise prone to collection of debris and leaves, and also allows a freer flow of water through the area, especially over the use of walls or baffles that stop the natural water flow.

The extended face 12 may be a curved face and/or include a curved front at a meeting of the first and second front walls.

Figure 2:
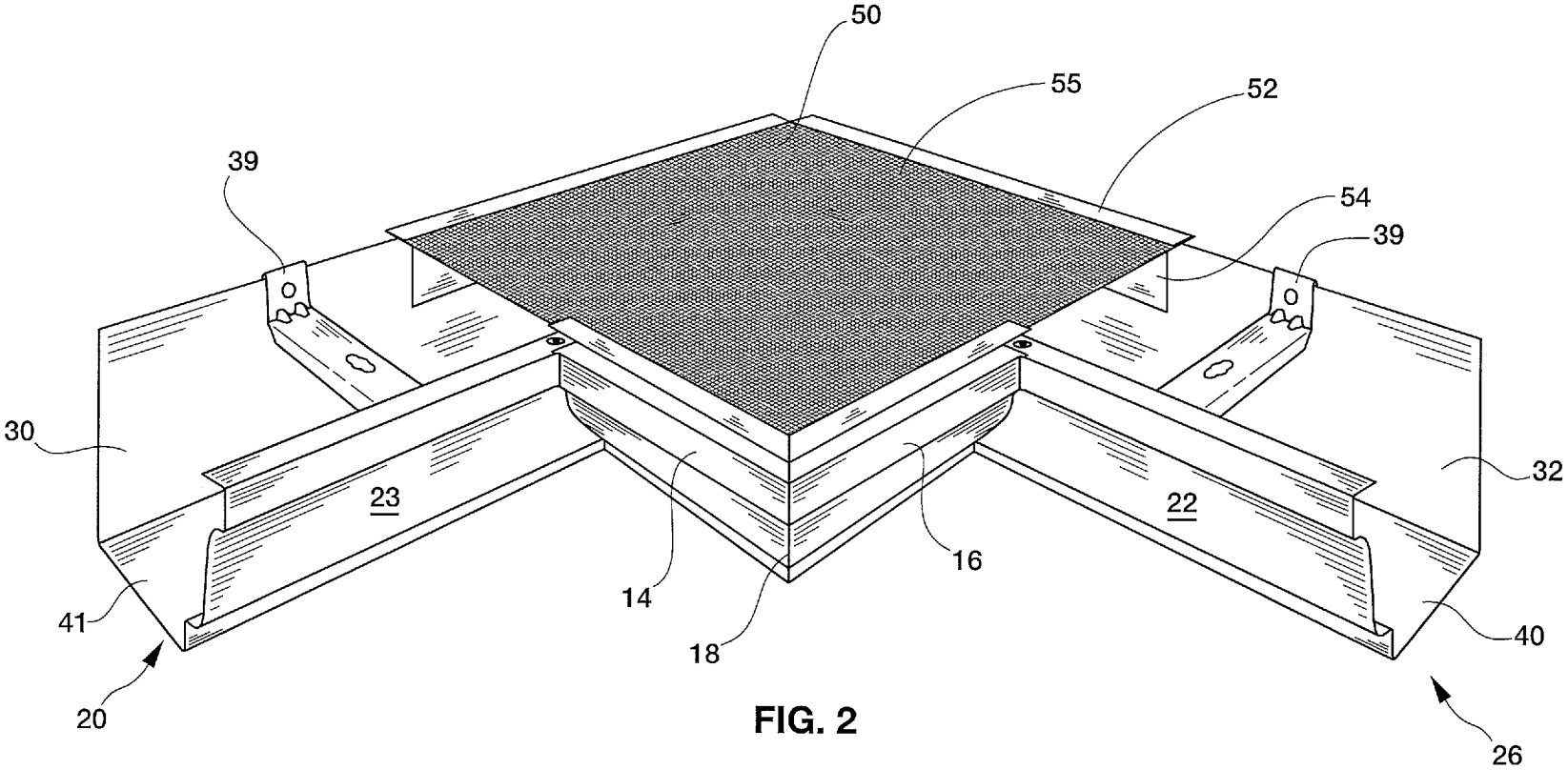
FIG. 2 is a front perspective view of one example of a gutter corner extension of the present disclosure having a cover.
Figure 2A:
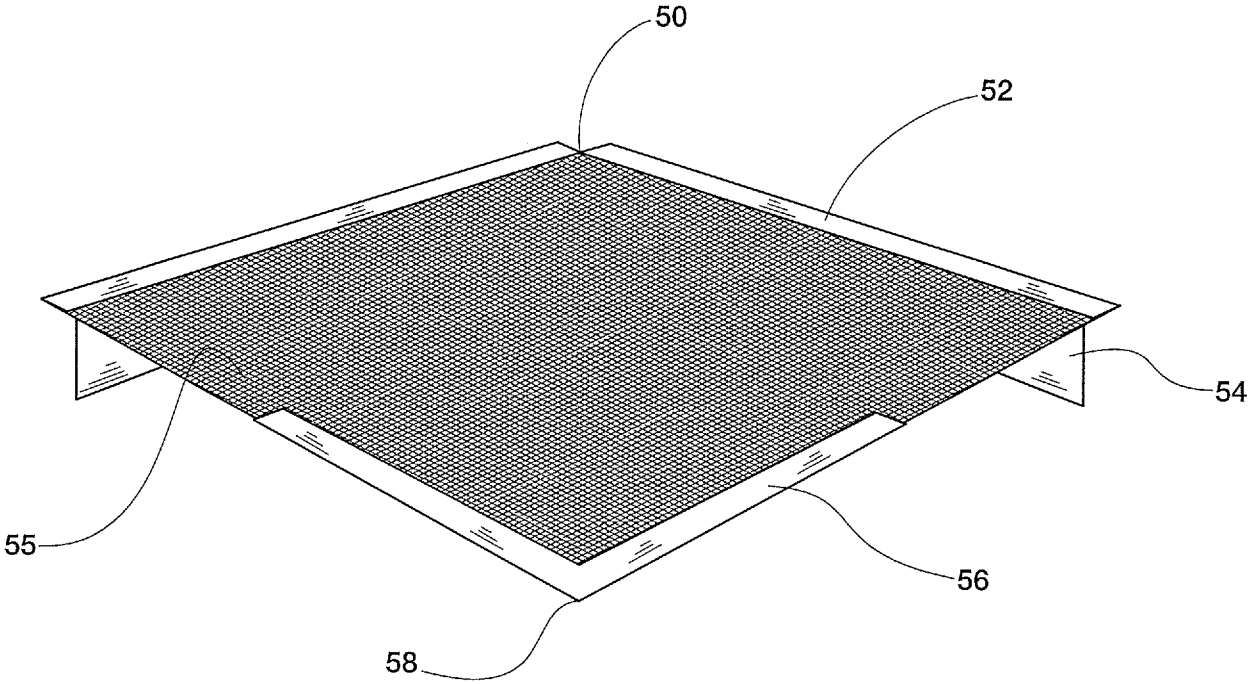
FIG. 2A is a front perspective view of the cover of FIG. 2.
Figure 2B:
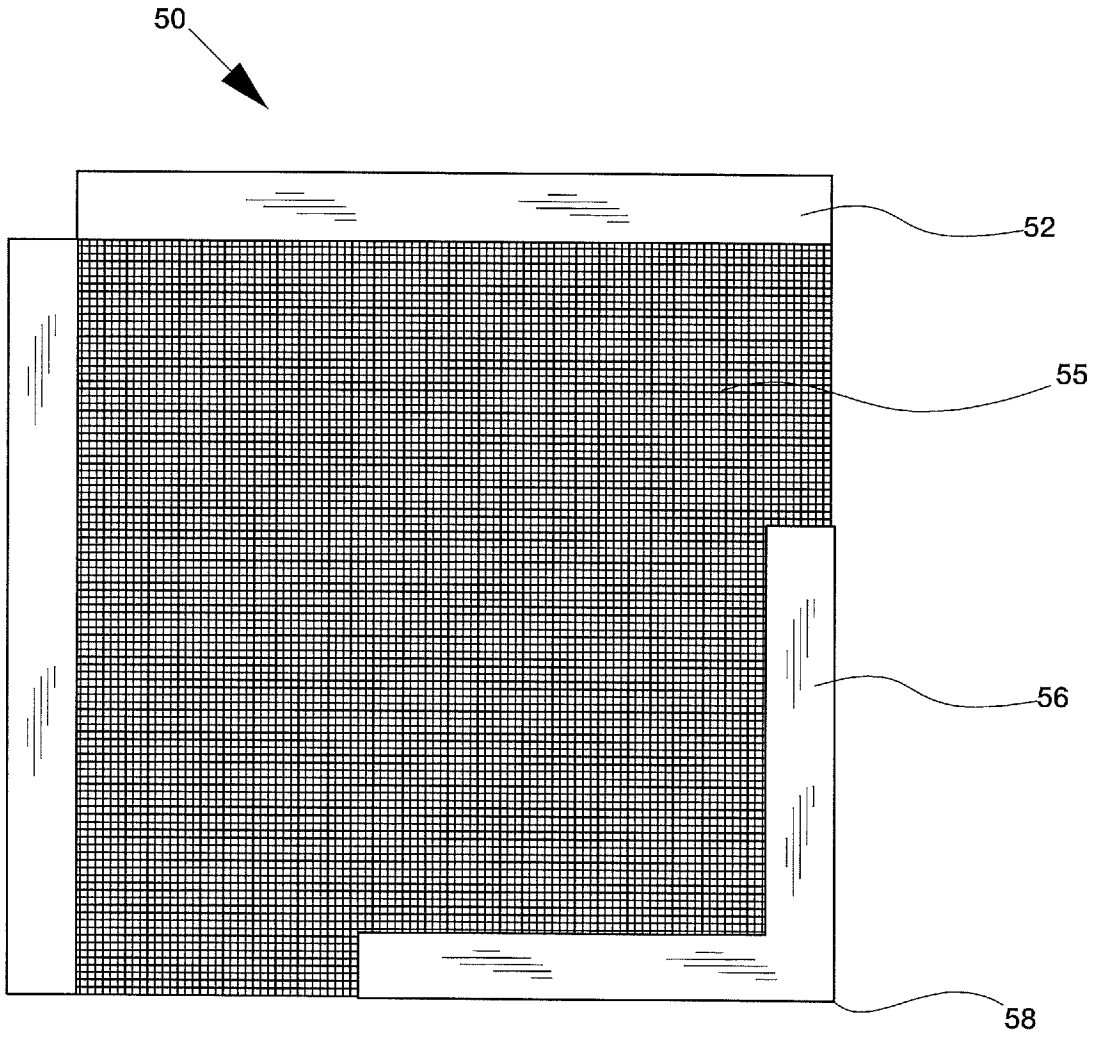
FIG. 2B is a top view of the cover of FIG. 2.
Figure 2C:
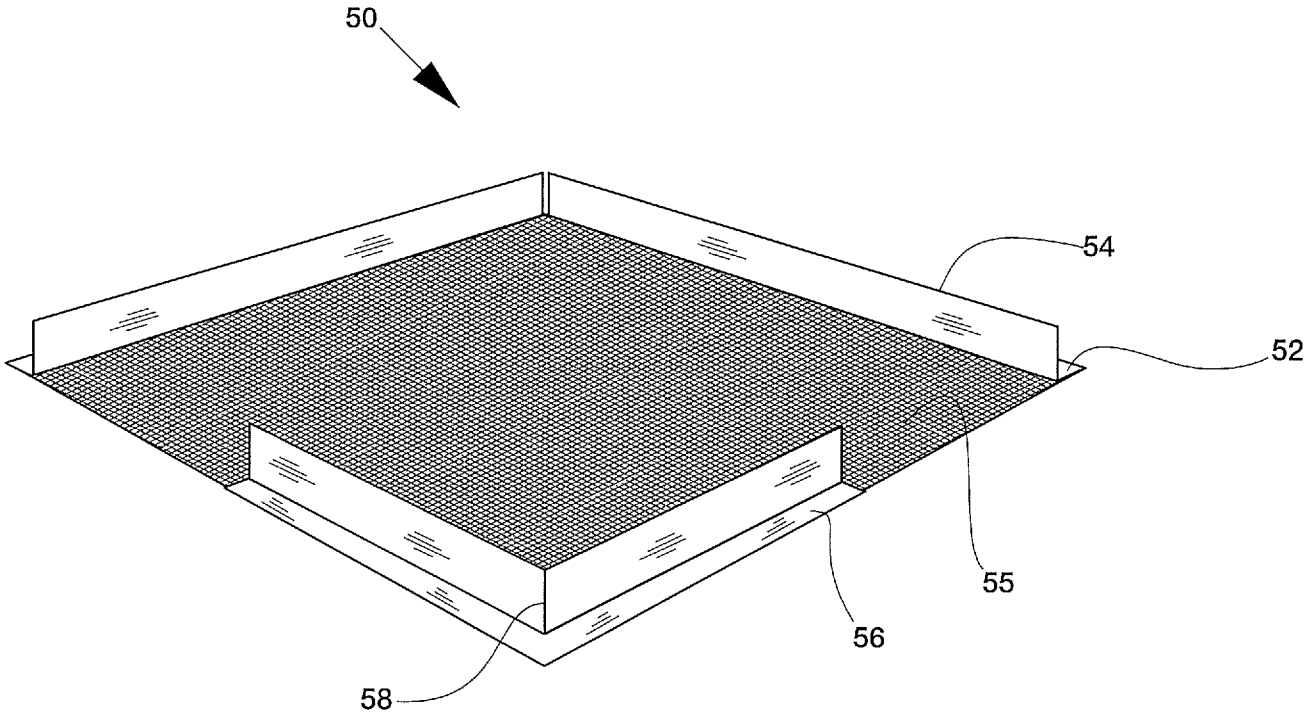
FIG. 2C is a bottom view of the cover of FIG. 2.

The gutter extension 10 may include an extension cover (FIGS. 2-2C). Extension cover 50 may mate with extended face 12 and mimic the dimensions of the extension 10. Gutter extension 10 may include a center portion 55 that allows water but not larger sediment and debris, such leaves, to pass through, for example a screen. Extension cover 50 may also include a top rim 52 and/or a top rim 56 on an opposite side of the cover for resting the cover 50 on the gutter extension 10. Cover 50 may also include portions 54 extending from a bottom of the cover and substantially perpendicularly to the rim 52 and/or 56. Rim 52, 56 and portion 54 may form an L-shaped lip on the cover to positionally secure the cover 50 on top of the extension 12. The extension cover may include a front corner projecting outwardly away from a back corner of the cover.

Figure 3:
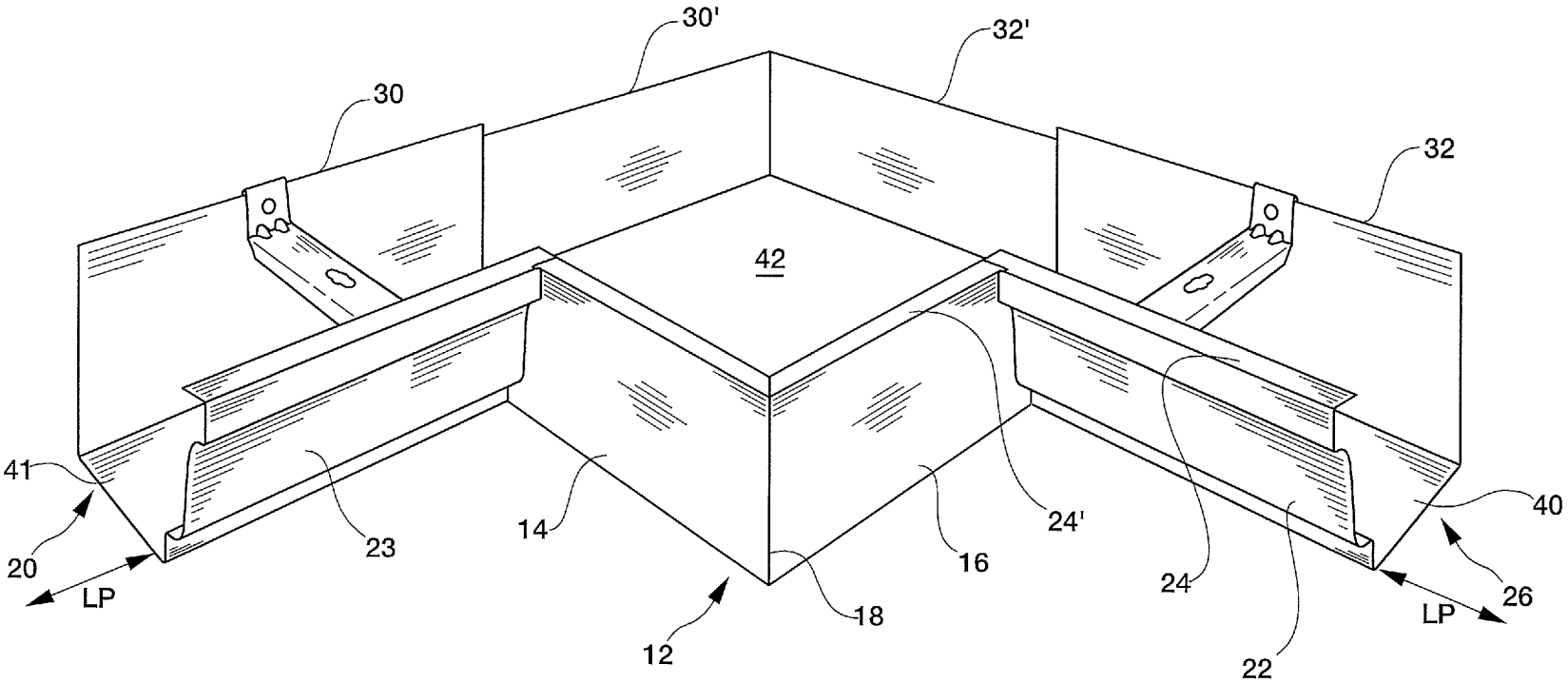
FIG. 3 is a front perspective view of one embodiment of a gutter corner extension of the present disclosure.

Extended face 12 may be aesthetically matched to take on the design of the outer face of a particular gutter and/or an existing and preinstalled gutter. Alternatively, the color of the gutter may be matched while the outer face of the extension 12 takes on a more linear, squared shape and appearance (as opposed to a more contoured shape and appearance) as seen in FIG. 3.

Figure 3A:
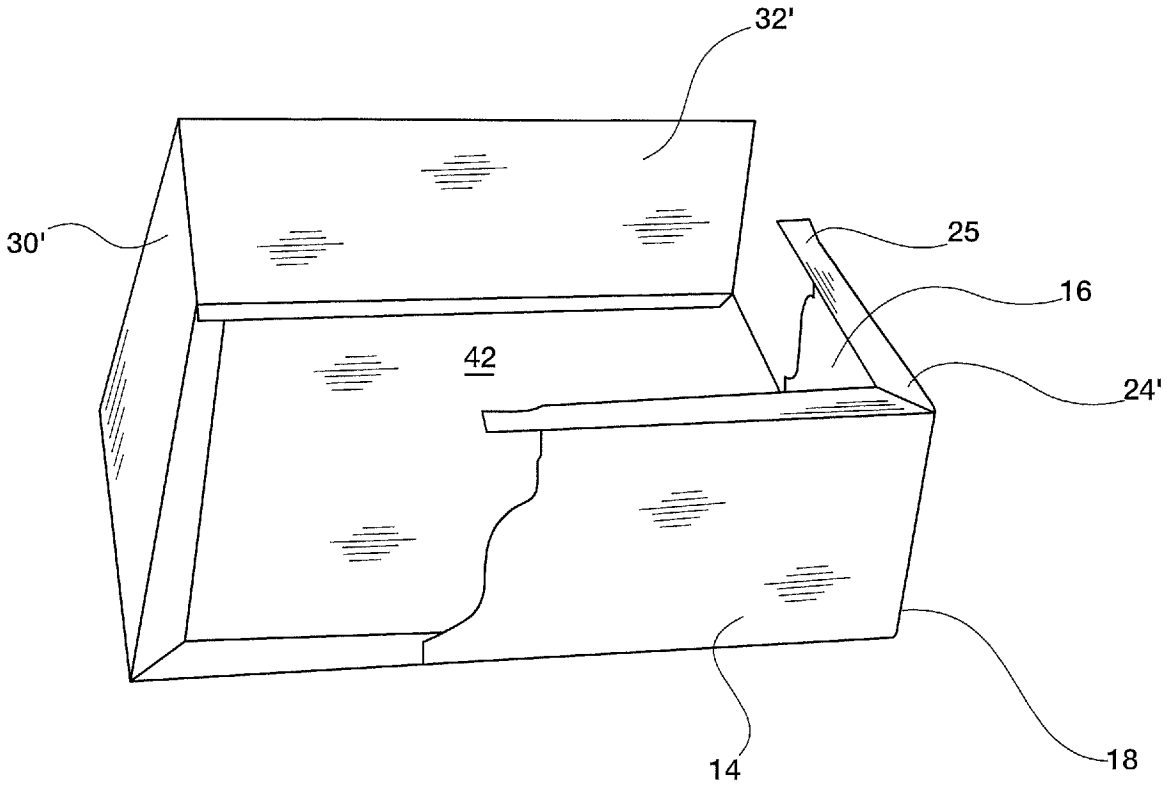
FIG. 3A is a perspective side view of one example of the gutter corner extension of FIG. 3.
Figure 3B:
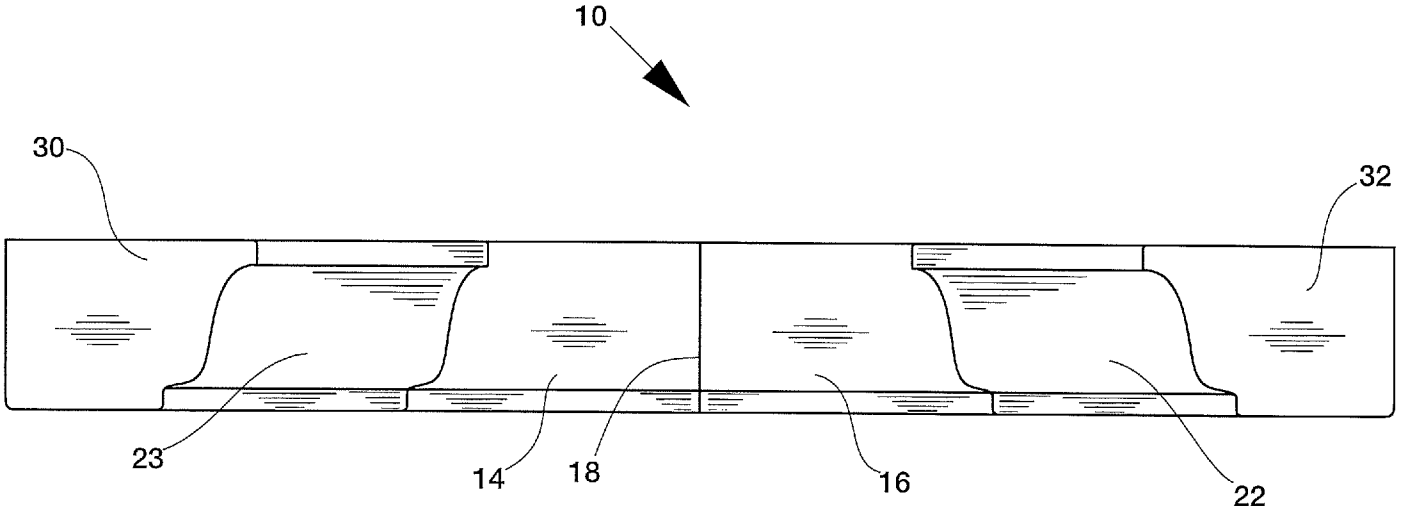
FIG. 3B is a front view of one example of the gutter corner extension of FIG. 3.
Figure 3C:
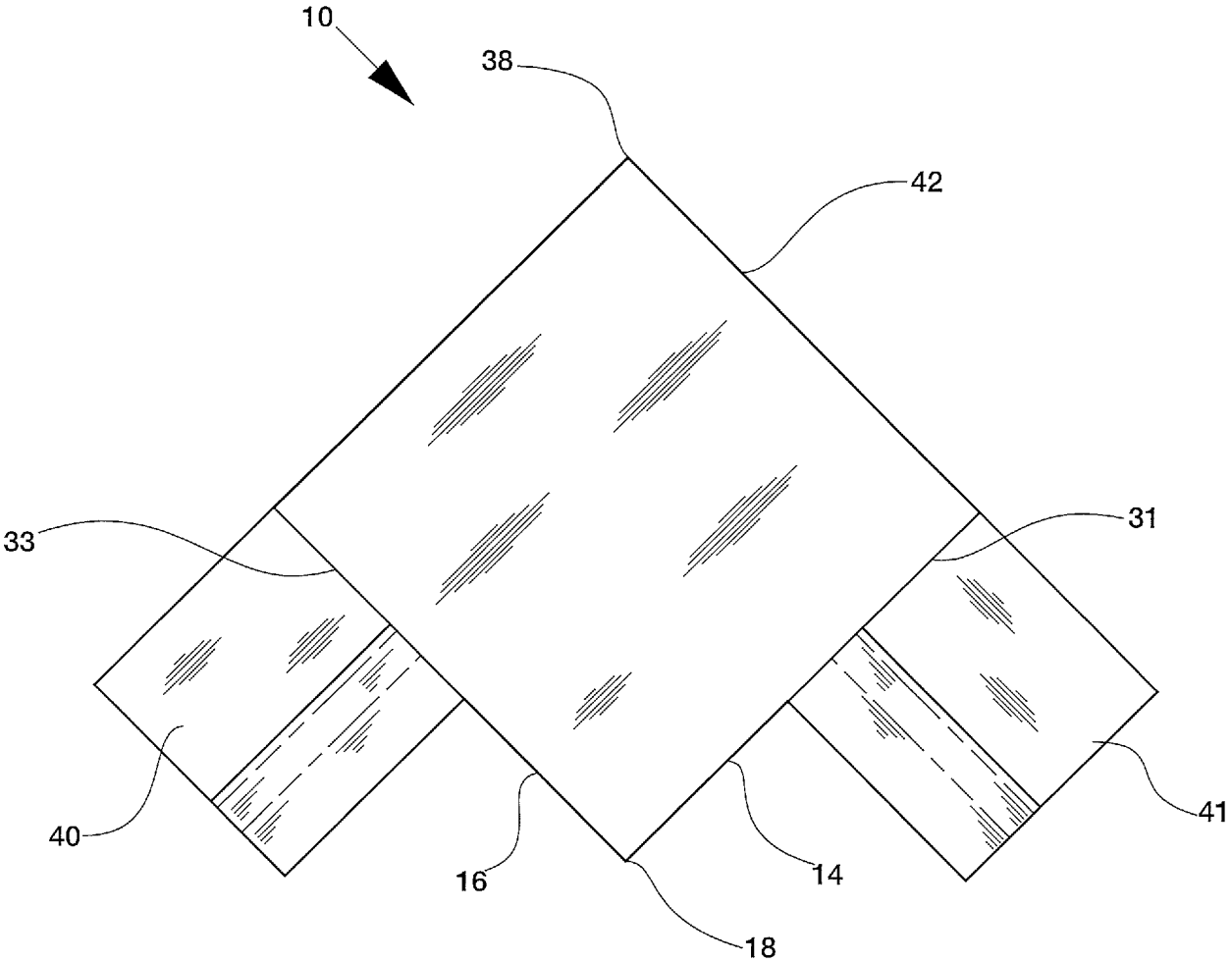
FIG. 3C is a bottom view of one example of the gutter corner extension of FIG. 3.

Shown in FIG. 3A, the extension may be a box insert. The box insert may be substantially square or may take on other shapes. By way of example, the front walls 14, 16 may be straight as shown or may take on the curved design, one example as shown on front walls in FIG. 1. The insert may have cutouts that fit with, accept, and/or adjoin existing gutter openings.

Figure 4:
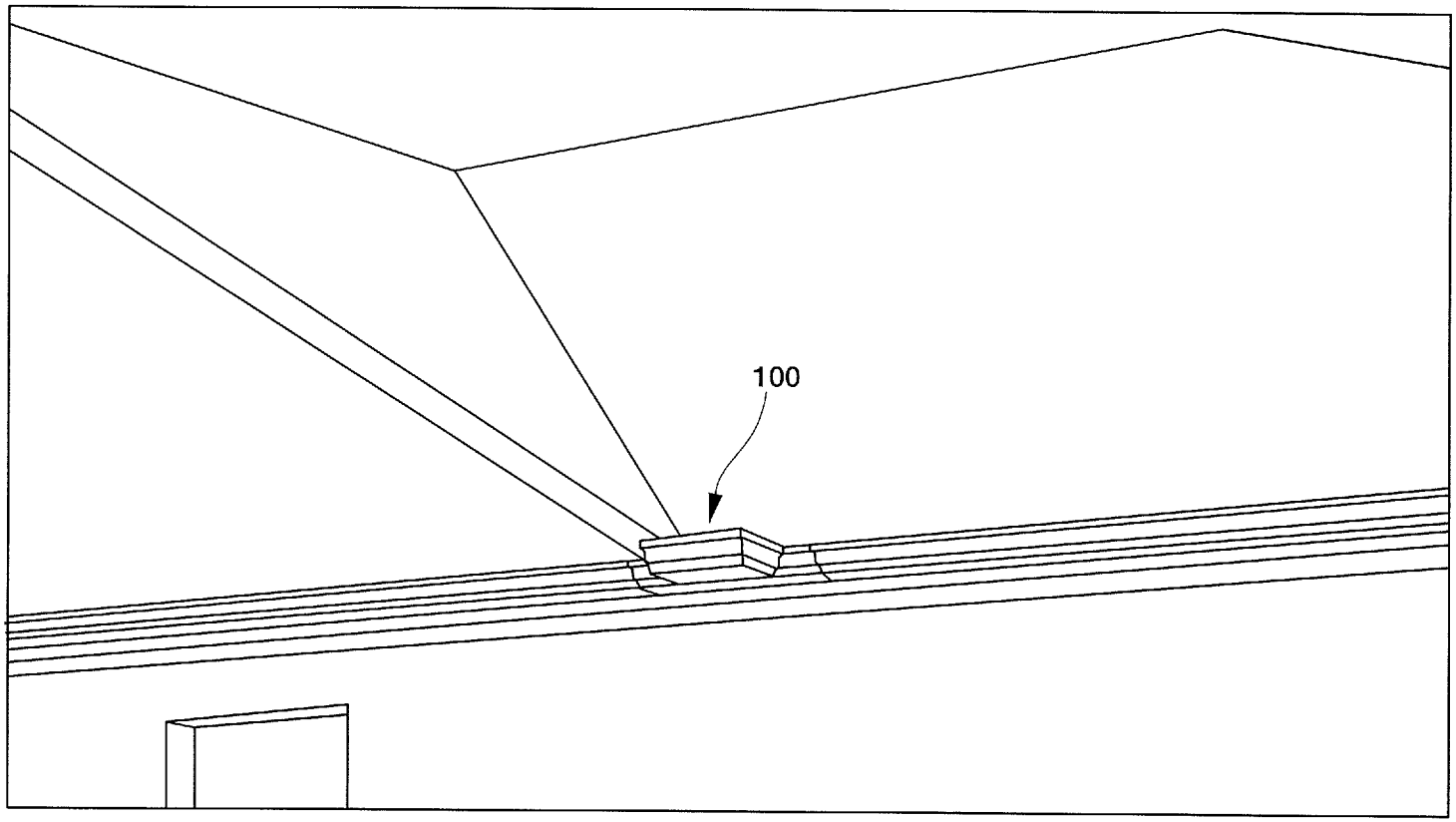
FIG. 4 shows one example of a linear gutter extension of a gutter system of the present disclosure attached to a building.
Figure 5:
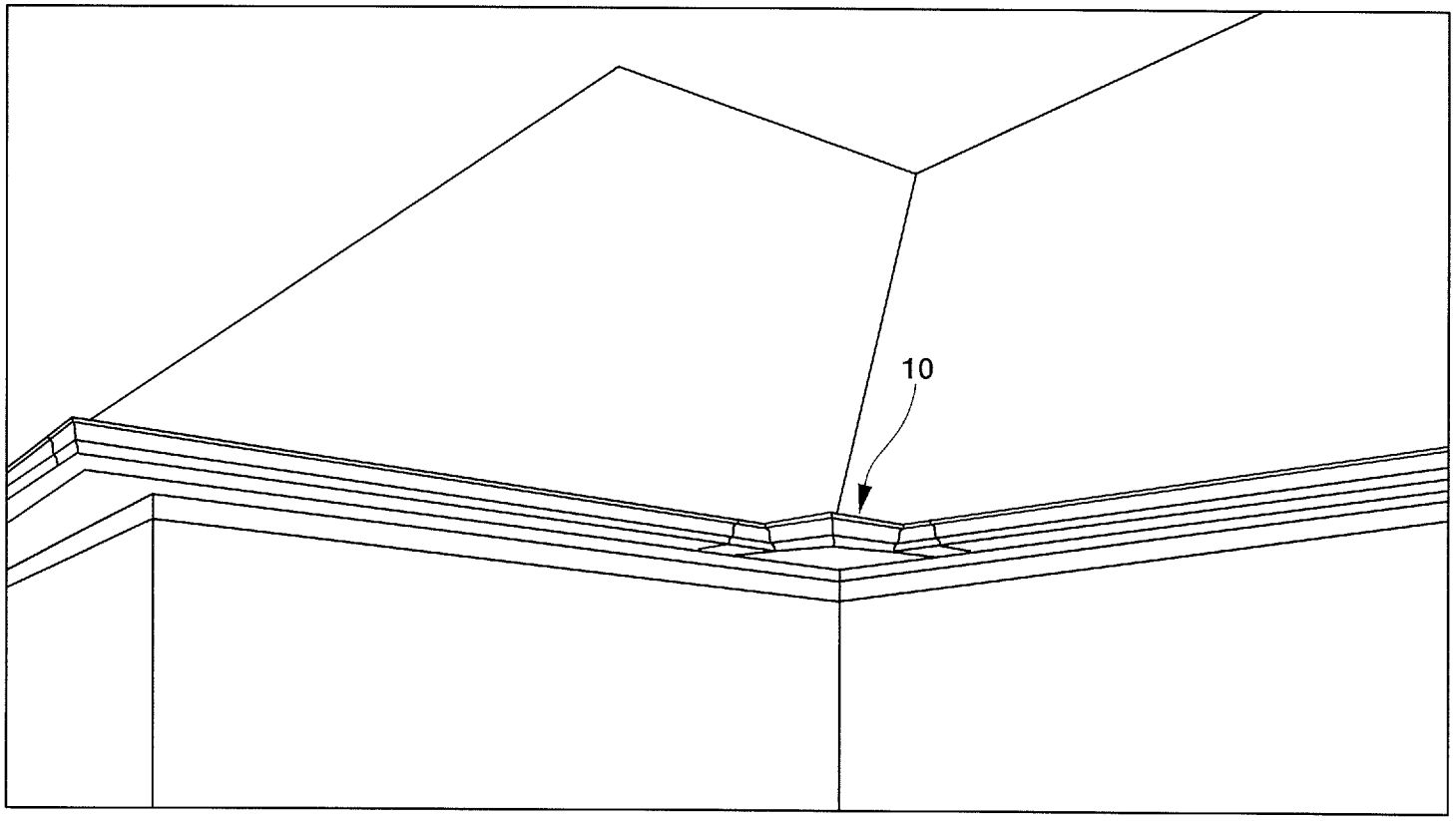
FIG. 5 shows one example of a gutter corner extension of a gutter system of the present disclosure attached to a building.

FIG. 5 shows a gutter extension 10 in use on a gutter system of a building. FIG. 4 shows another embodiment 100 of a gutter extension in use on a gutter system of a building. Gutter extension 10 may be advantageous, for example, in a portion of a gutter occurring in a corner where the gutter is required to take a turn, for example about a 90 degree turn. Gutter extension 100 may be advantageous, for example, where a valley channels water into a linear portion of the gutter, not in a corner or a turn of the gutter system.

In some examples, the straight line gutter 100, with an extended face may be about 2 to about 6 inches wider and configured to better receive all excess water coming from a roof valley that is not discharging into a ninety degree corner or miter. The angled face of this example helps channel the water in either direction it may need to go depending on the downspout location. The extension increase in size of this example may be about a 50%+/−5% increase above standard gutter sizing. This increase may eliminate the need of a deflector on the top lip of the gutter to keep water from jumping over and also may eliminate the damming effect that deflectors cause when leaves are being blown or washed from roof valleys.

The corner extension with an extended face 10 is configured, in one example, to handle roof valleys shuttling water and entering the gutter where the gutter is making a ninety degree turn. The face of this corner piece may extend out about 100% more than a standard factory corner piece in some embodiments. This configuration enables the corner piece to handle excessive volumes of water and channel the water away instead of pouring over the gutter, as conventional gutter systems often do, even with only a modest rainfall.

The corner piece extension 10 may operate effectively without need for a deflector to keep the water from overflowing and prevents the damming effect of leaves in the valleys. The design of this example also provides a cleaner appearance of the gutter system as a whole and mates seamlessly with the gutter system of the building.

The corner and linear gutter extensions of the present disclosure provide a cost efficient option to overcome gutter water flow overflow and mismanagement without the need for replacement or installation of whole gutter systems.

Some examples also include where extended face 12 is a partial insert that creates an extended face with a substantially 90 degree angle forming a front corner 18 between two adjoining walls of the extended face 14, 16 that attach to a gutter system and may include a bottom.

Figure 6:
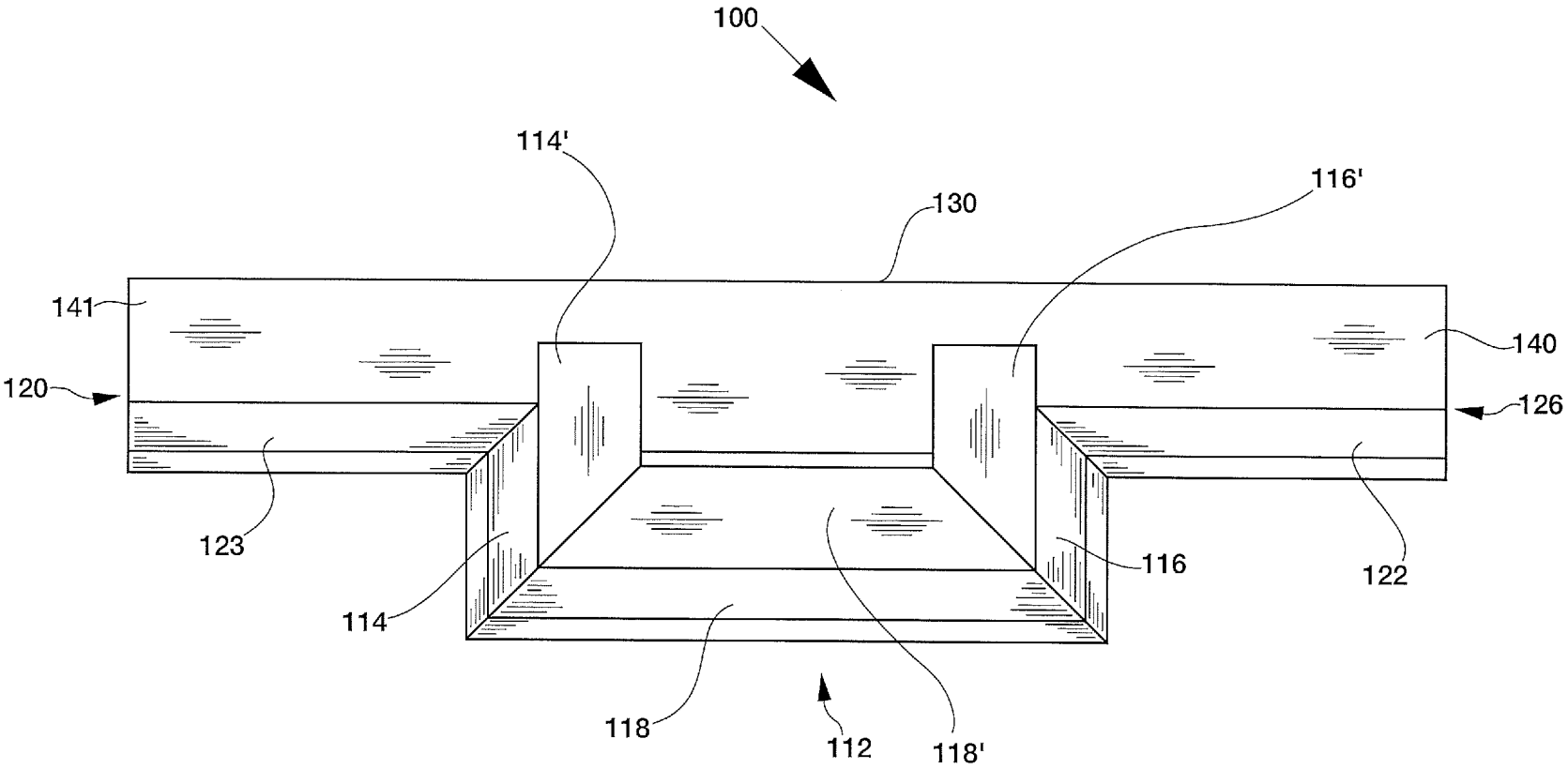
FIG. 6 is a top view of one embodiment of a linear gutter extension according to the present disclosure.
Figure 6A:
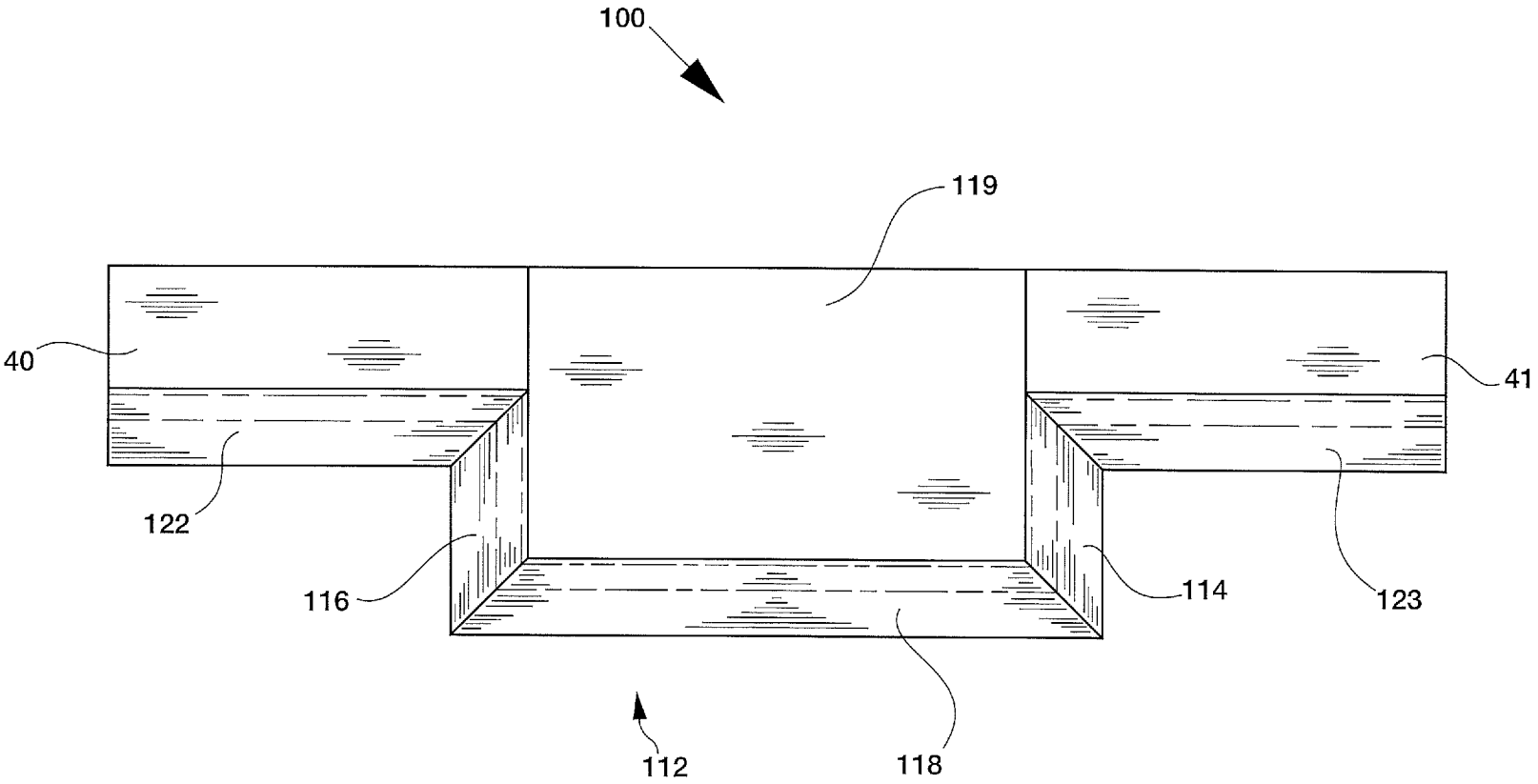
FIG. 6A is a bottom view of one example of a linear gutter extension of FIG. 6.
Figure 6B:
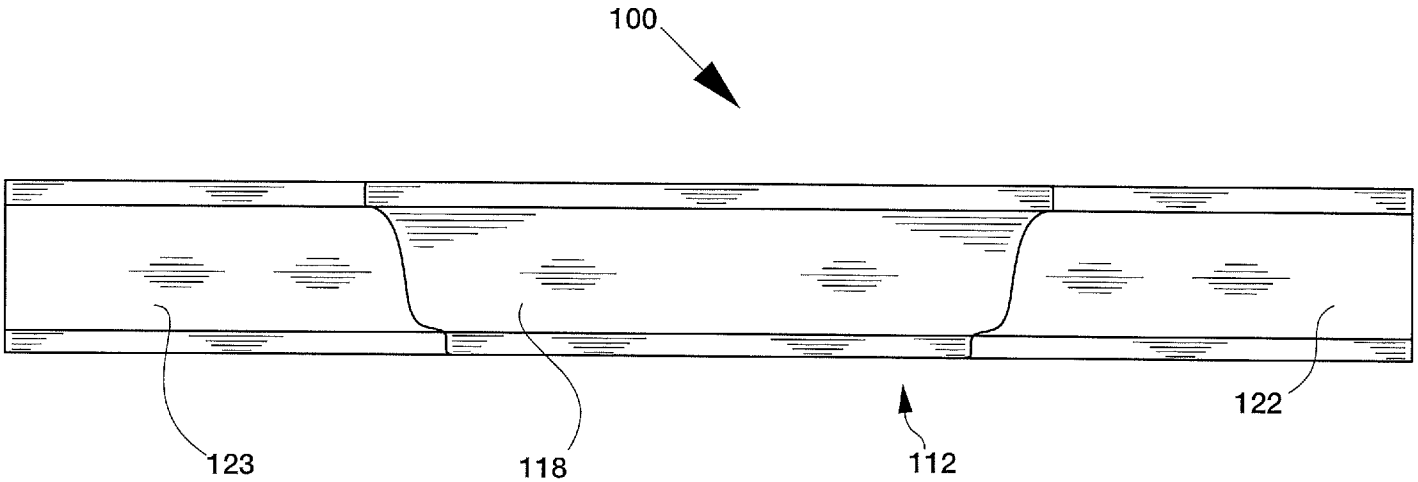
FIG. 6B is a front view of one example of a linear gutter extension of FIG. 6.
Figure 6C:
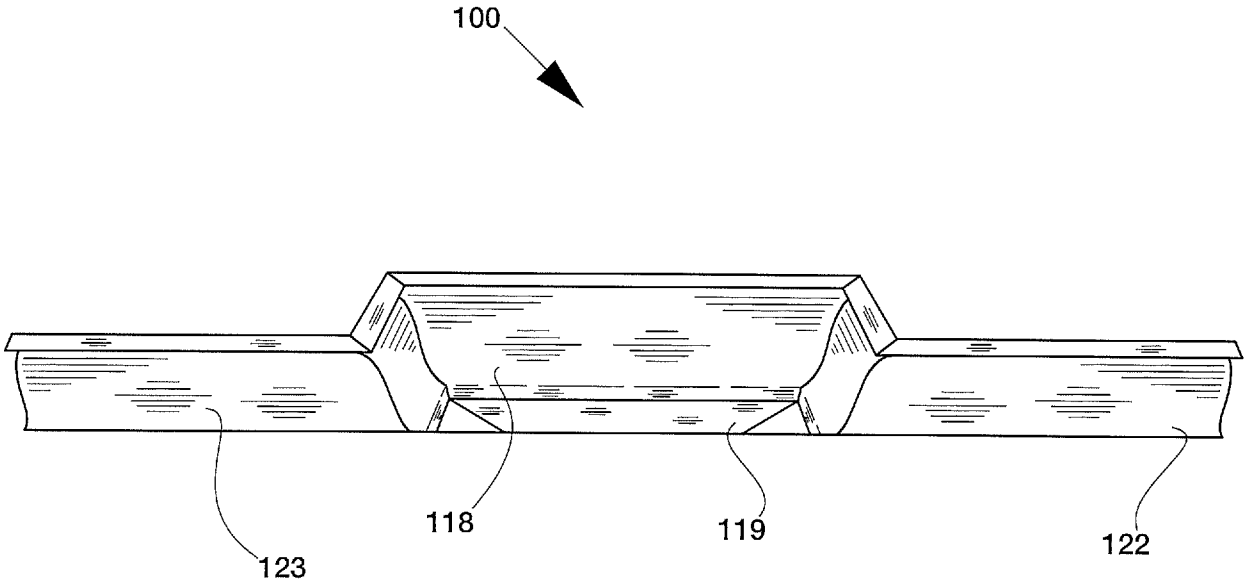
FIG. 6C is a front perspective view of one example of a linear gutter extension according to the present disclosure.
Figure 6D:
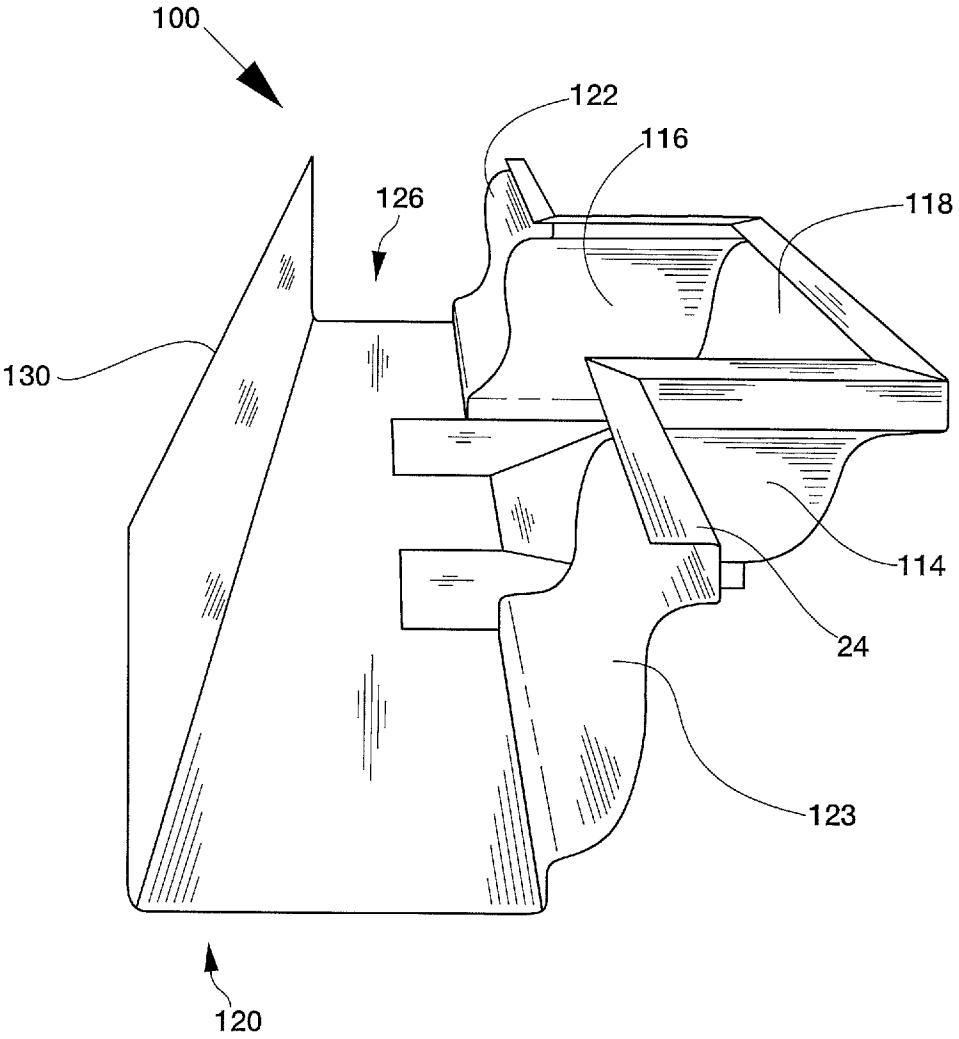
FIG. 6D is a side view of one example of a linear gutter extension of FIG. 6.
Figure 6E:
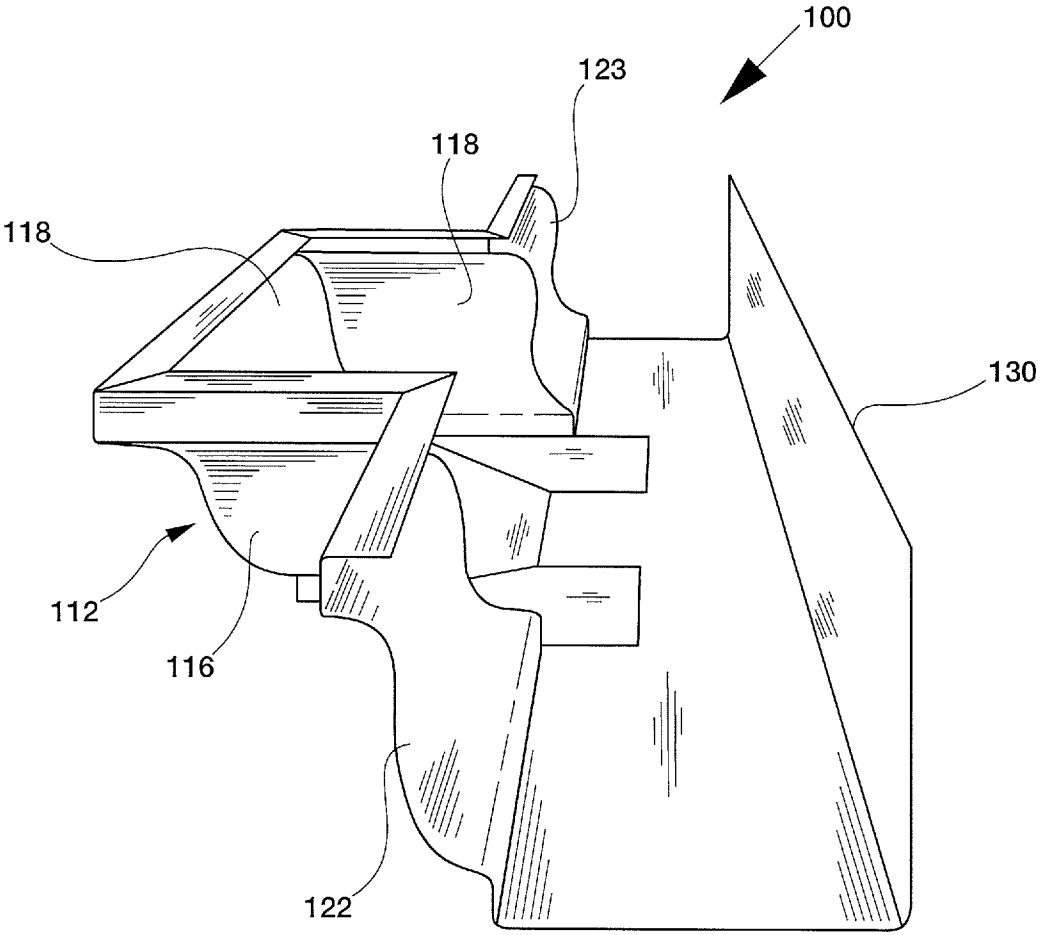
FIG. 6E is an opposite side view of the linear gutter extension of FIG. 6D.

FIG. 6 shows one example of a gutter extension 100 including an extended face 112, at least two front extension walls 114, 116 and a bottom. In some examples, the extended face 112 projects outward away from a back wall.

Some examples of the extension may include gutter arms 120, 126 on each side of the extended face 112. The gutter arms may include back wall 130, bottom 119 and/or gutter front walls 122, 123. In certain examples, the gutter arms may be between about 1 and about 5 inches each in length. In another example, the gutter arms 120, 126 may be about 1.5 to about 2.5 inches each in length.

Figure 7:
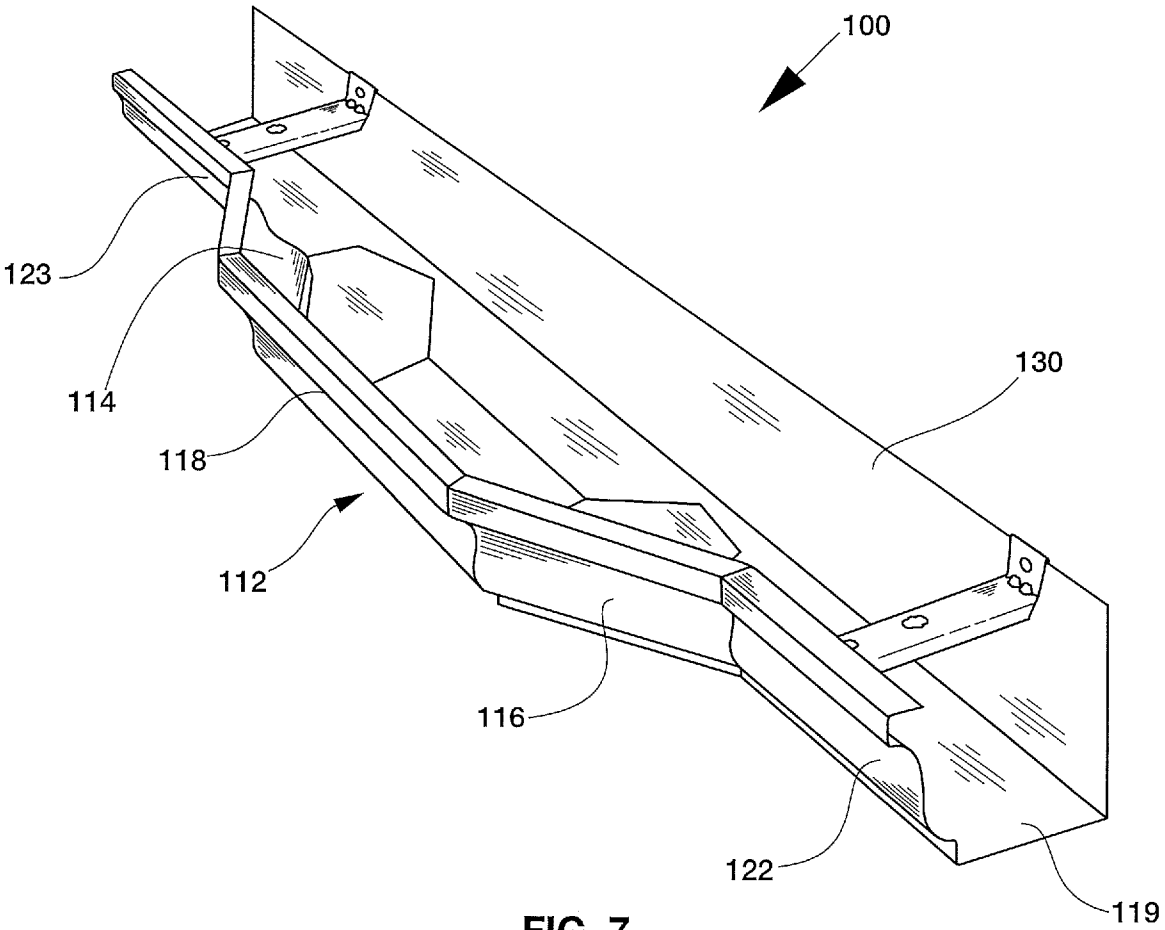
FIG. 7 is a side perspective view of one example of a linear gutter extension partial insert according to the present disclosure.
Figure 7A:
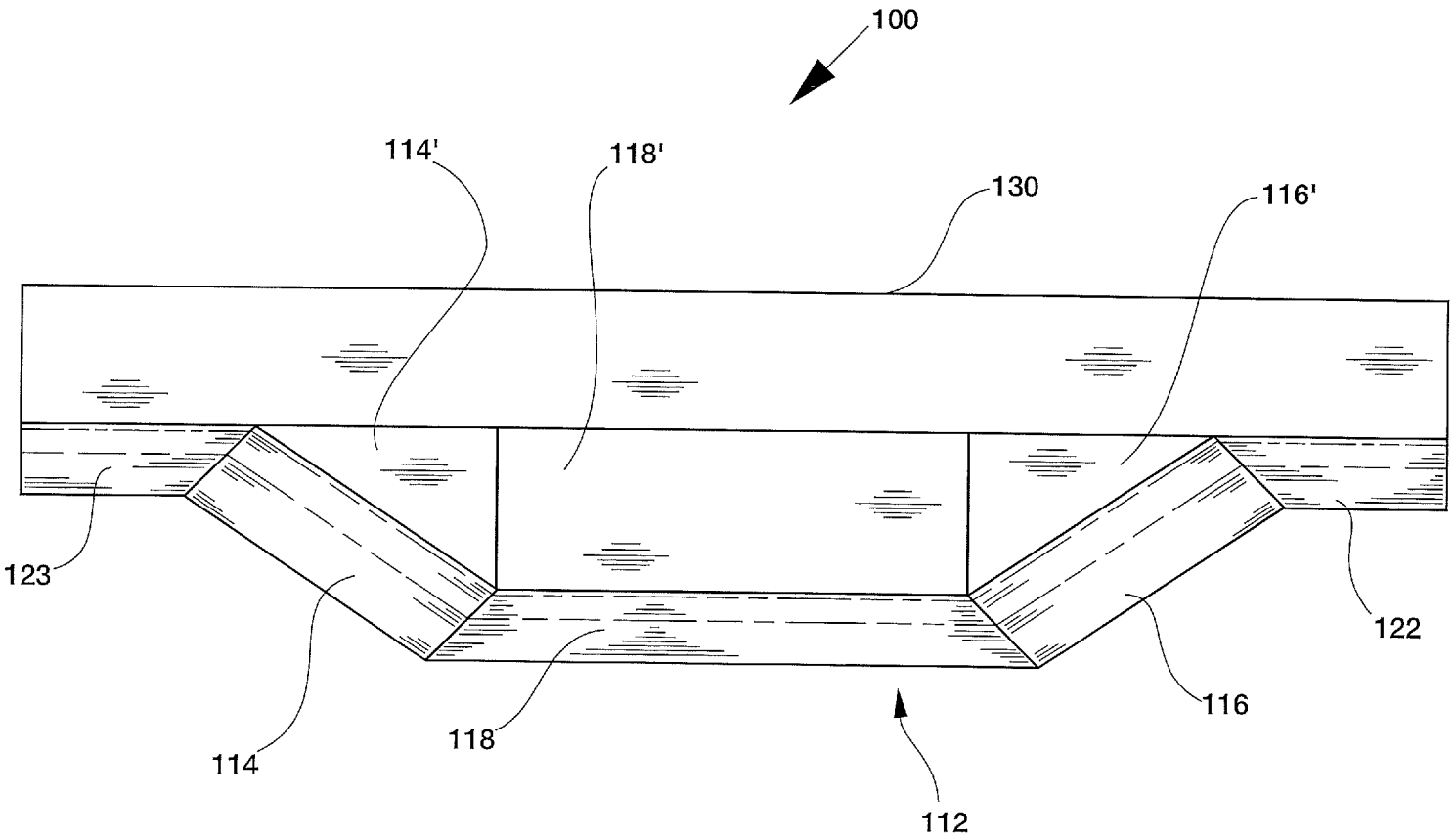
FIG. 7A is a top perspective view of one example of a full linear gutter extension insert.
Figure 7B:
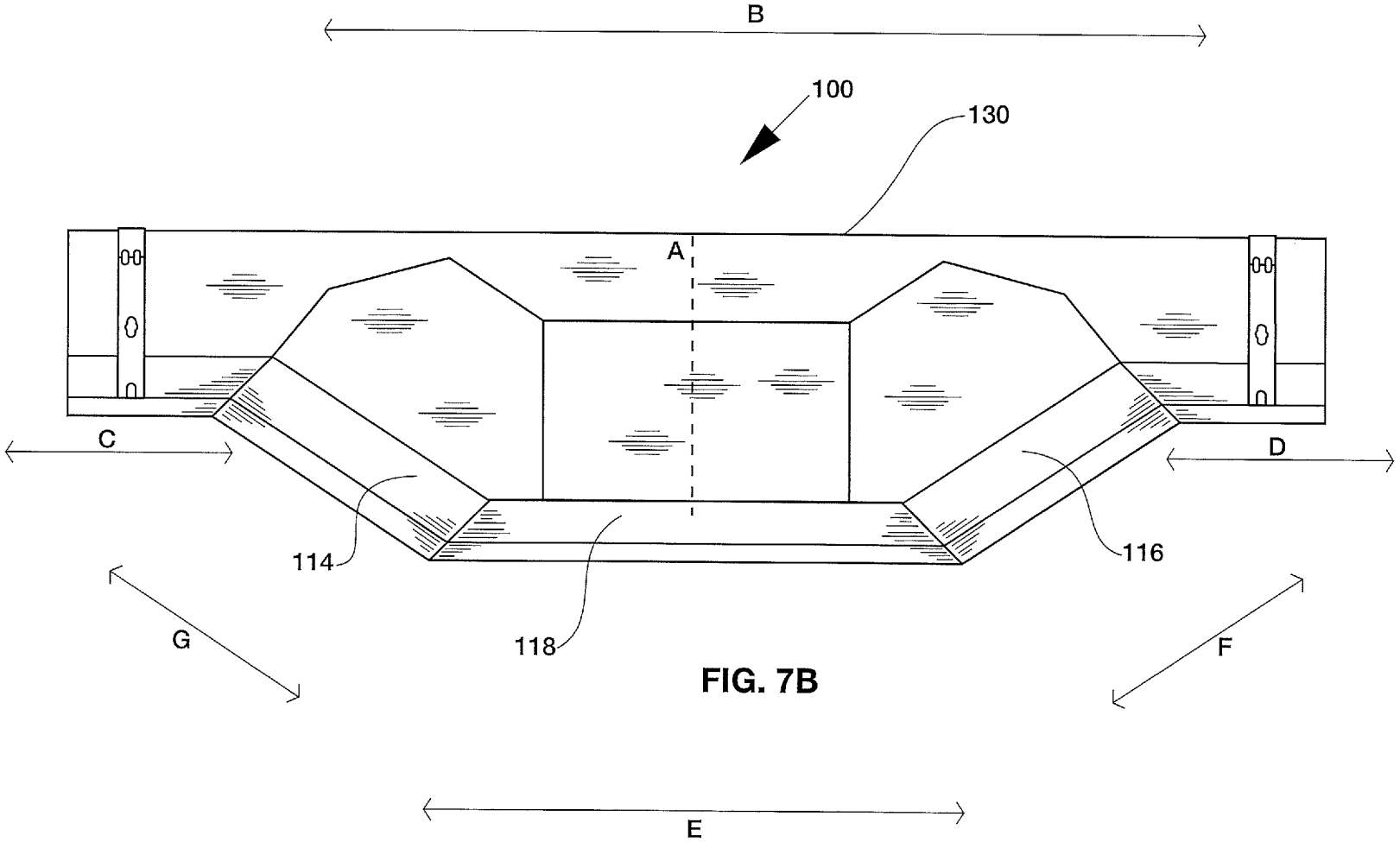
FIG. 7B is a top perspective view of one example of the linear gutter extension partial insert according to FIG. 7.
Figure 7C:
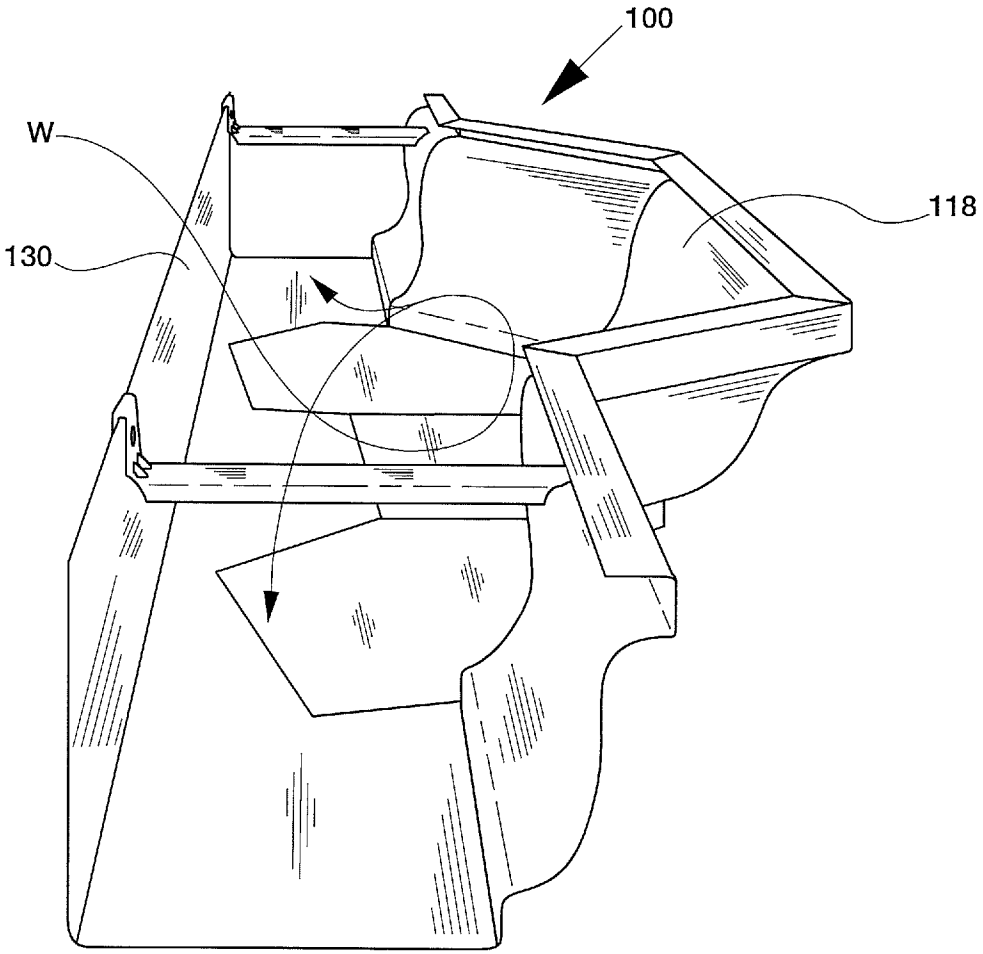
FIG. 7C is a side view of one example of the linear gutter extension partial insert according to FIG. 7.
Figure 7D:
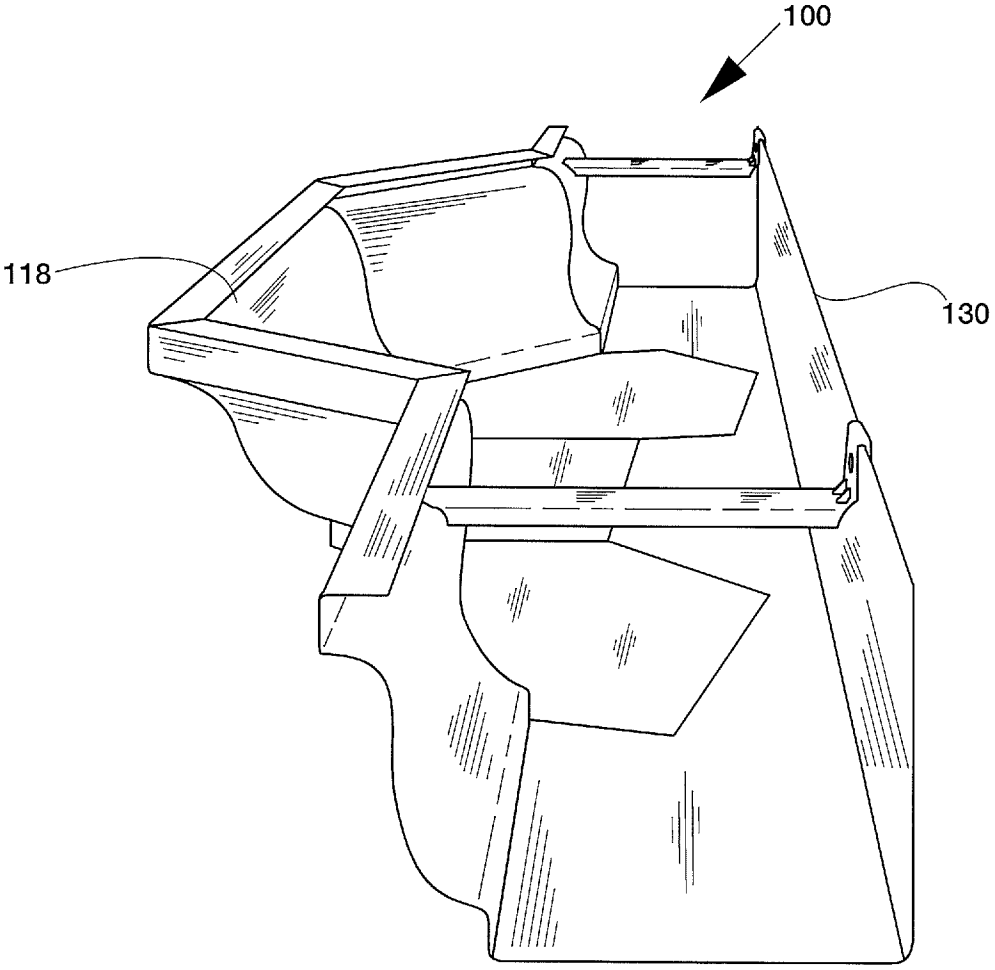
FIG. 7D is an opposite side view of one example of the linear gutter extension partial insert of FIG. 7C.

FIGS. 6-7D show examples of a gutter extension 112 for a linear portion of a gutter system. The back wall 130 may be in one linear plane (B in FIG. 7B). The extended face 112 may project past a linear plane formed by an outer face of the adjoining gutter (C/D in FIG. 7B).

The extension, in certain examples, includes a third wall 118 between at least two front walls 114, 116. The third wall 118, in one example, is substantially parallel with a back wall (B, E of FIG. 7B). In other examples, a third wall 118 may include a front wall on one side and may terminate to an end on the opposite side, in one example, such that the termination end is the width of the gutter from the back wall to the extended third face. In this example, the extension may on one side may include a third wall 118 and a front wall 114. The front wall 114 may be, in some embodiments, between 5 inches and 8 inches in width from the back wall and project away from the back wall. The front wall 114 may project away from the back wall at an angle of between 45 degrees and 90 degrees. On the opposite side, the extension may terminate at an end and not tie back into the gutter system on the opposite side. The end may, by way of example, may include a width of between 5 inches and 8 inches from the back wall to the third wall 118.

In one example, a first wall 114 and a second wall 116 may be substantially parallel to each other and the first wall 114 and second wall 116 each have an end that intersects substantially perpendicularly at the end with said third wall 118. The first wall 114 and the second wall 116 each may have a second end that intersects substantially perpendicularly with a gutter front wall 122, 123. The first wall 114 and the second wall 116 may be non-parallel to the gutter front wall 118 and the back wall 130.

The gutter front wall 122, 123 on each side of the extended face 112 may be in the same linear plane (C, D of FIG. 7B). The first wall 114 and the second wall 116 may extend outward from the linear plane (C,D) and interface with the third wall 118 to secure the third wall 118 in a parallel but separate linear plane (E). The area A of FIG. 7B creates a space for a collection of water to naturally flow into a linear gutter, preventing clogging and overflow while also allowing a symmetry with the linear gutter for a more natural and appealing structural result. In some examples, the gutter extension 12 may increase the space between the back 130 and the front wall 118 by about 2 to about 3 inches.

Figure 7E:
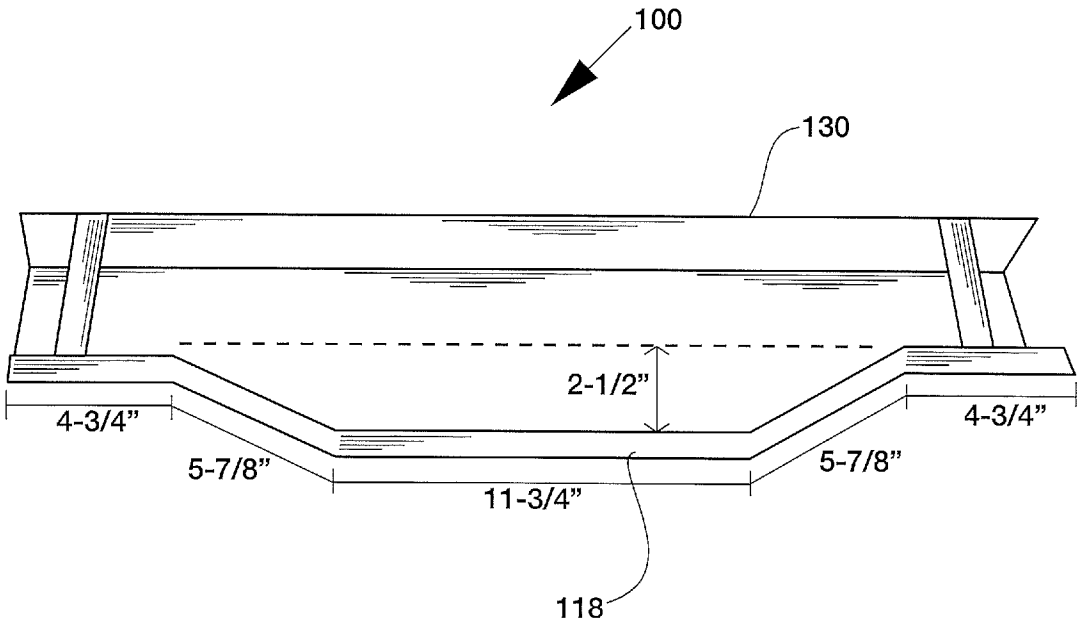
FIG. 7E is a top view of one example of the linear gutter extension according to FIG. 7.
Figure 7F:
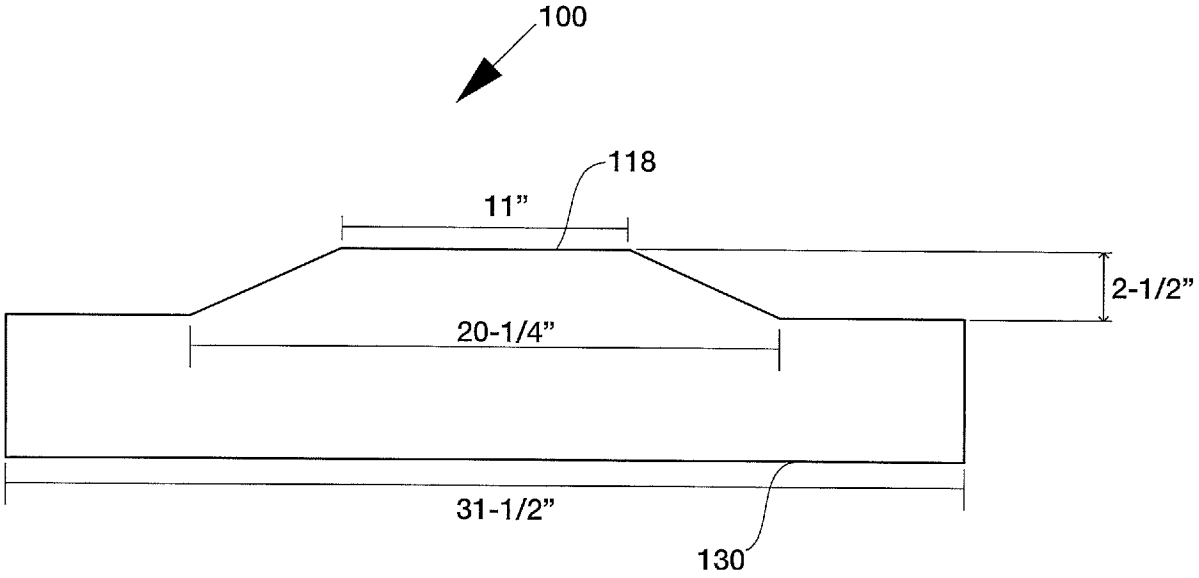
FIG. 7F is a bottom view of one example of the linear gutter extension according to FIG. 7.

The dimensions illustrated, for example, in FIGS. 7E and 7F, are exemplary for one embodiment of a gutter extension 100. The third wall 118 may extend outward from a back wall 130, in some examples by at least 5 inches, 6 inches, 7 inches, and/or more.

Figure 7G:
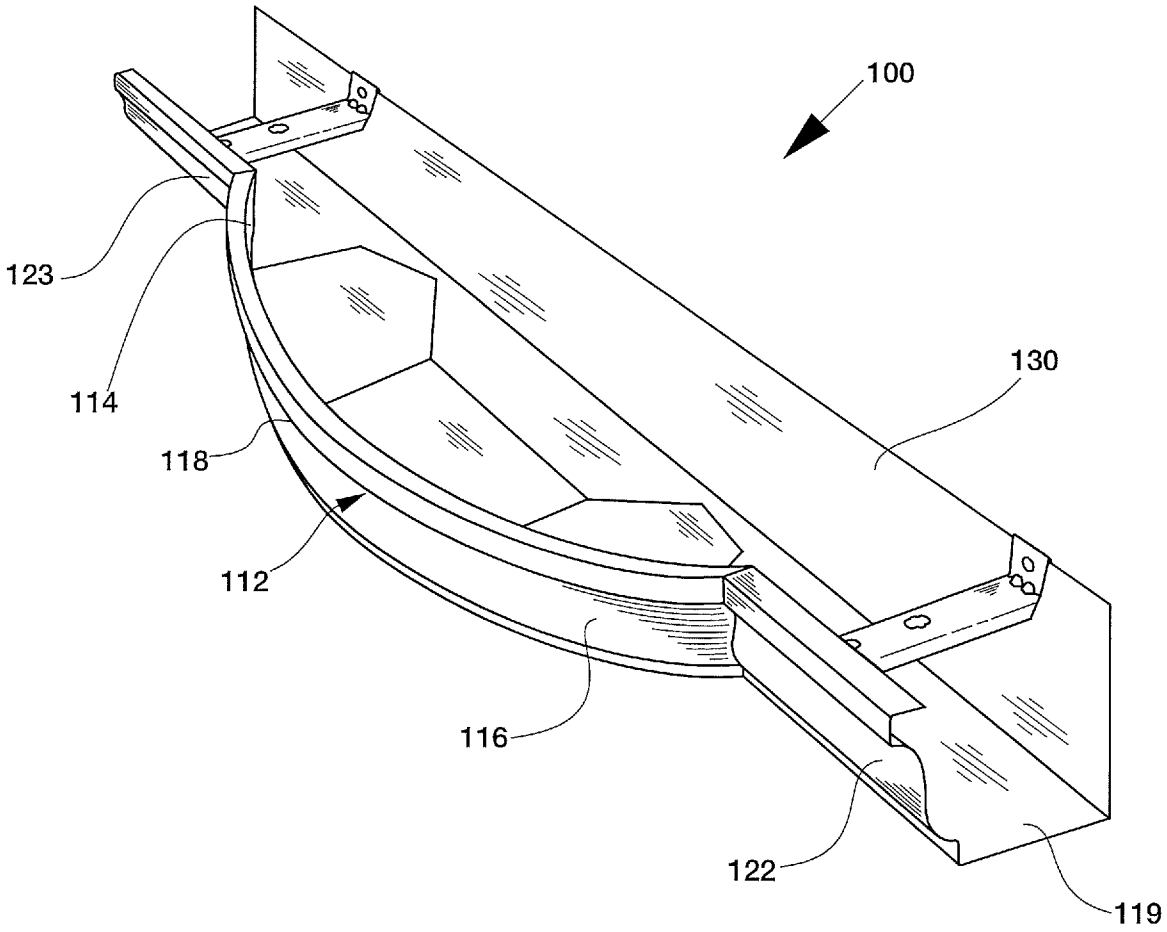
FIG. 7G is a side perspective view of one example of a gutter extension of the present disclosure, including a radius portion.

FIG. 7G shows on example of a gutter extension 100 including a radius and/or a curved portion. The third wall 118 may be all or partially curved. First wall 114 and second wall 116 may be curved walls coming together at a radius to form the third wall 118. In this example, third wall 118 is non-parallel to back wall 130 and curves away from back wall 130. A radius gutter extension 100 may increase water circulation due to elimination of corners and/or hard stops encountered by water flowing from the roof and through the gutter system.

The gutter extension as shown in FIG. 7 may include an extension cover 50 adapted to the top dimensions of a linear gutter extension 100.

Figure 8:
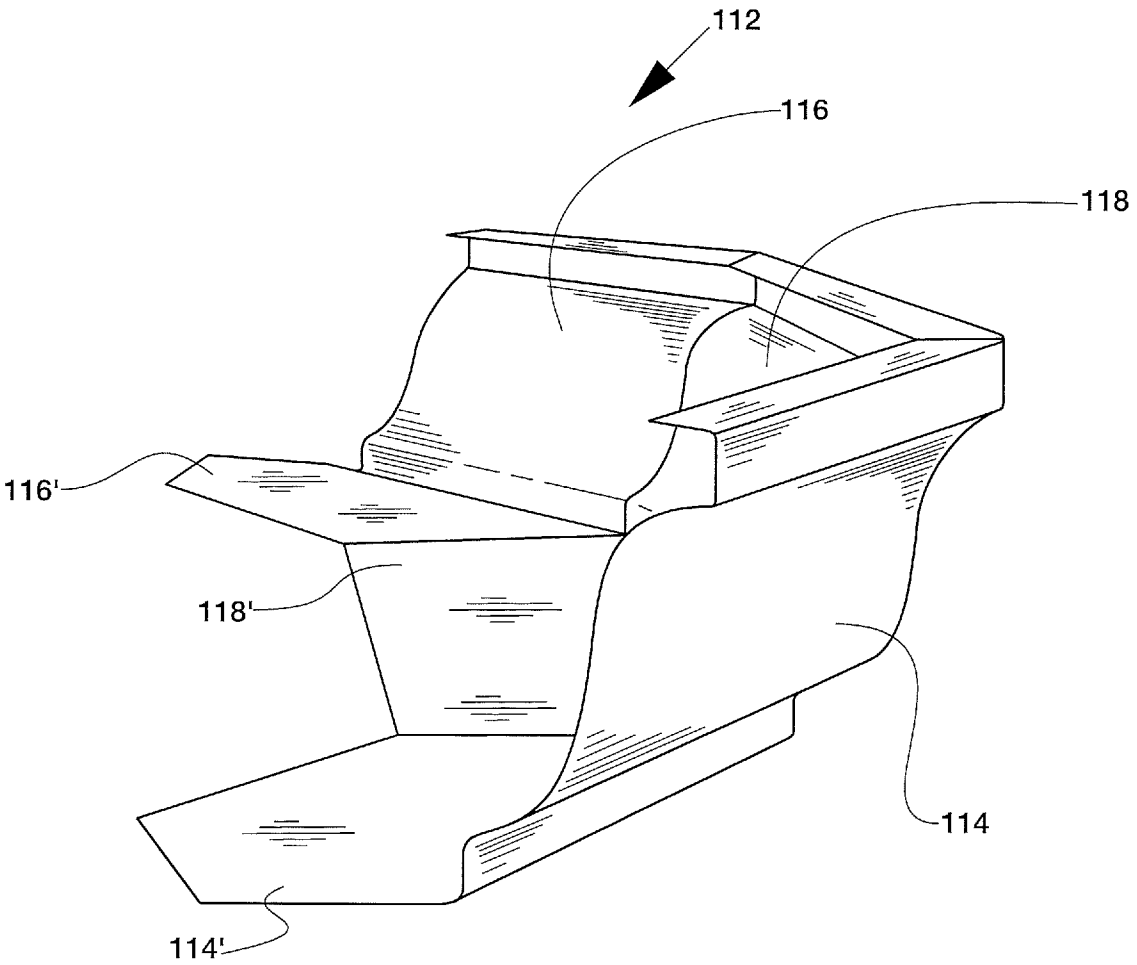
FIG. 8 is a side view another embodiment of a linear gutter extension partial insert according to the present disclosure.
Figure 8A:
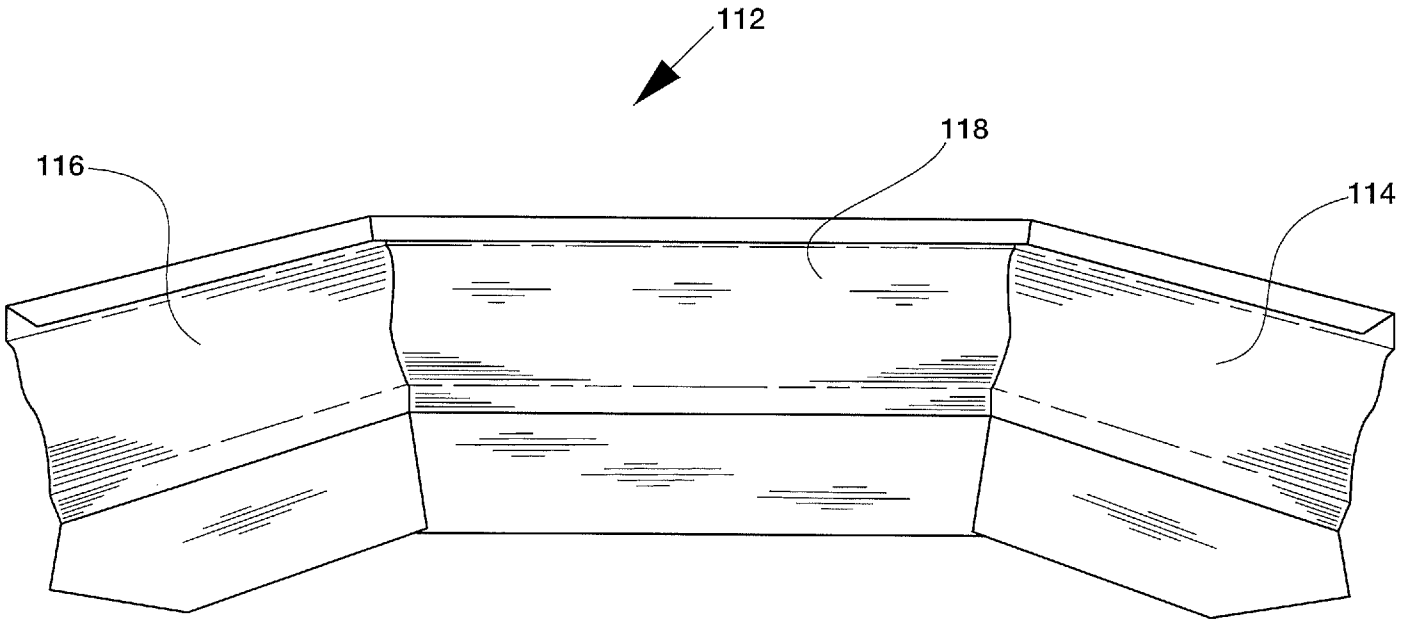
FIG. 8A is a back view of one example of the linear gutter extension partial insert of FIG. 8.
Figure 8B:
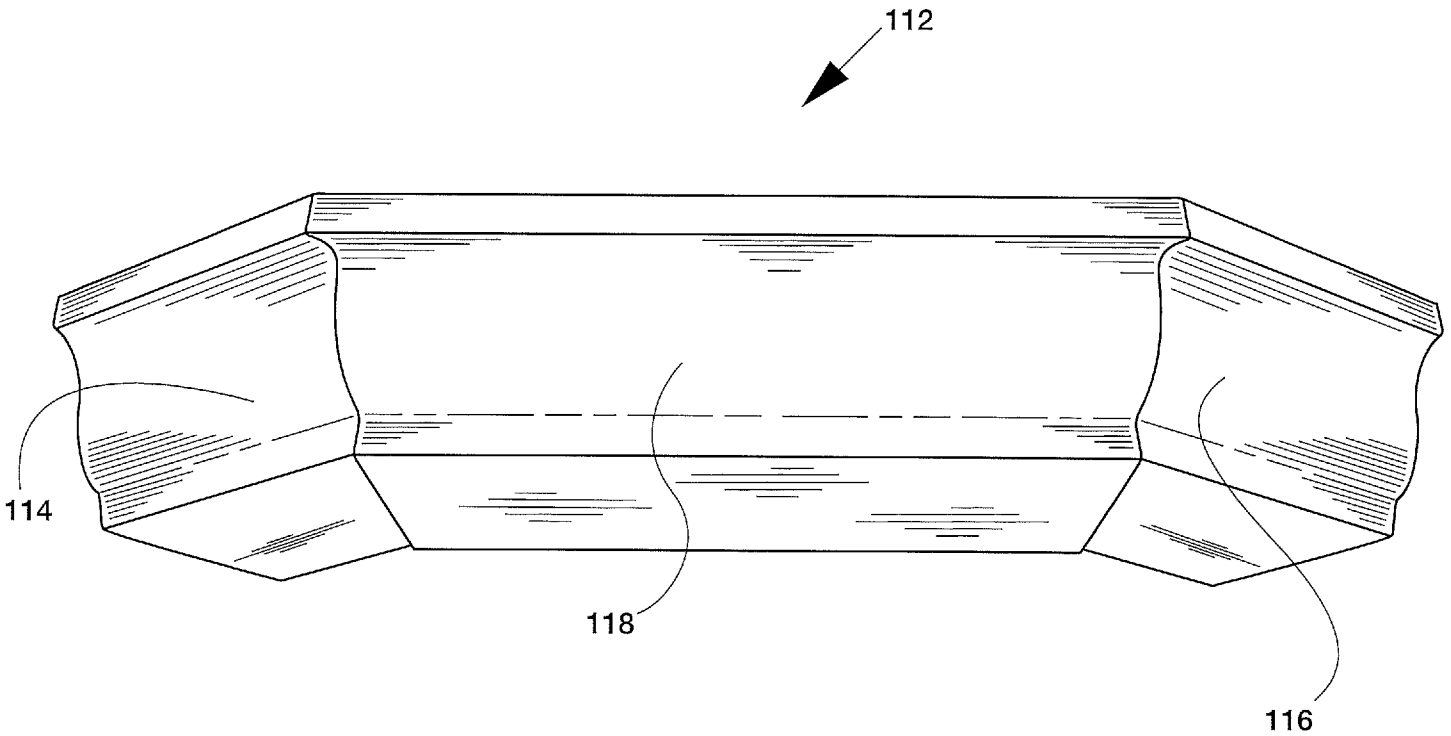
FIG. 8B is a front view of one example of the linear gutter extension partial insert of FIG. 8.
Figure 8C:
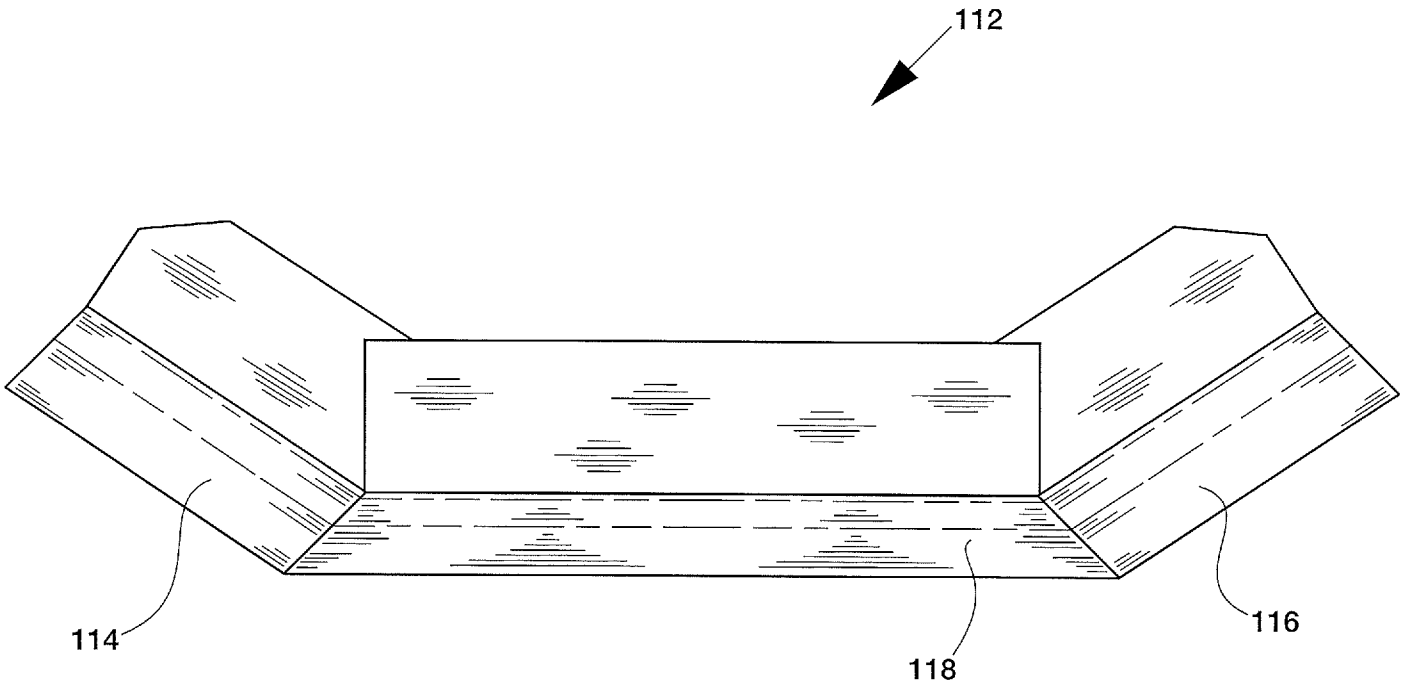
FIG. 8C is a bottom view of one example of the linear gutter extension partial insert of FIG. 8.
Figure 8D:
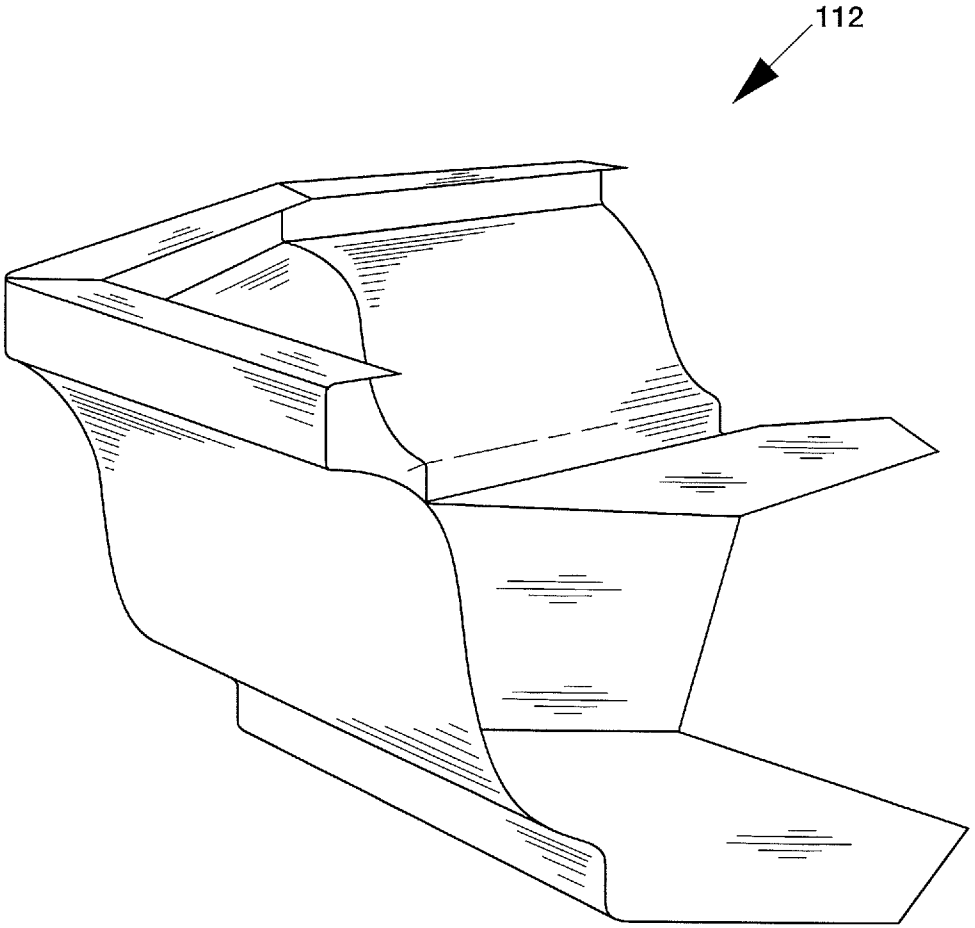
FIG. 8D is an opposite side view of one example of the linear gutter extension partial insert of FIG. 8.
Figure 8E:
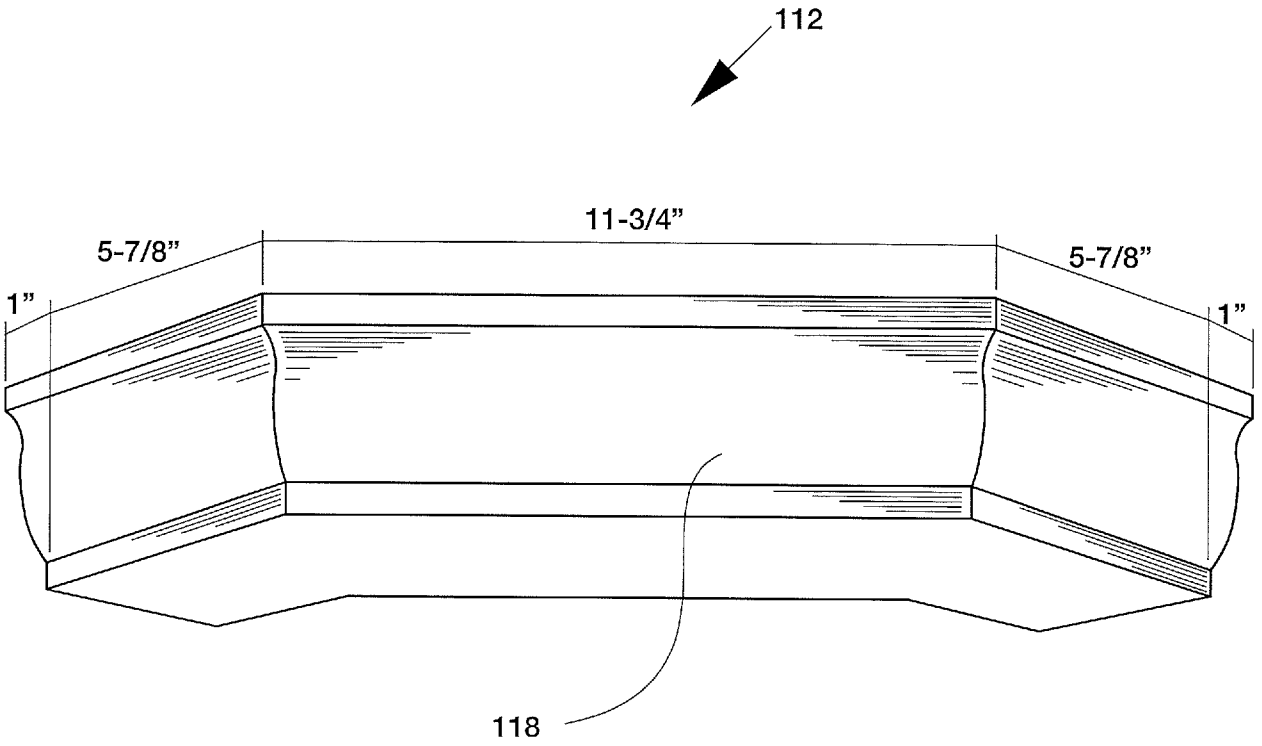
FIG. 8E is a front perspective view of one example of the linear gutter extension partial insert of FIG. 8.
Figure 8F:
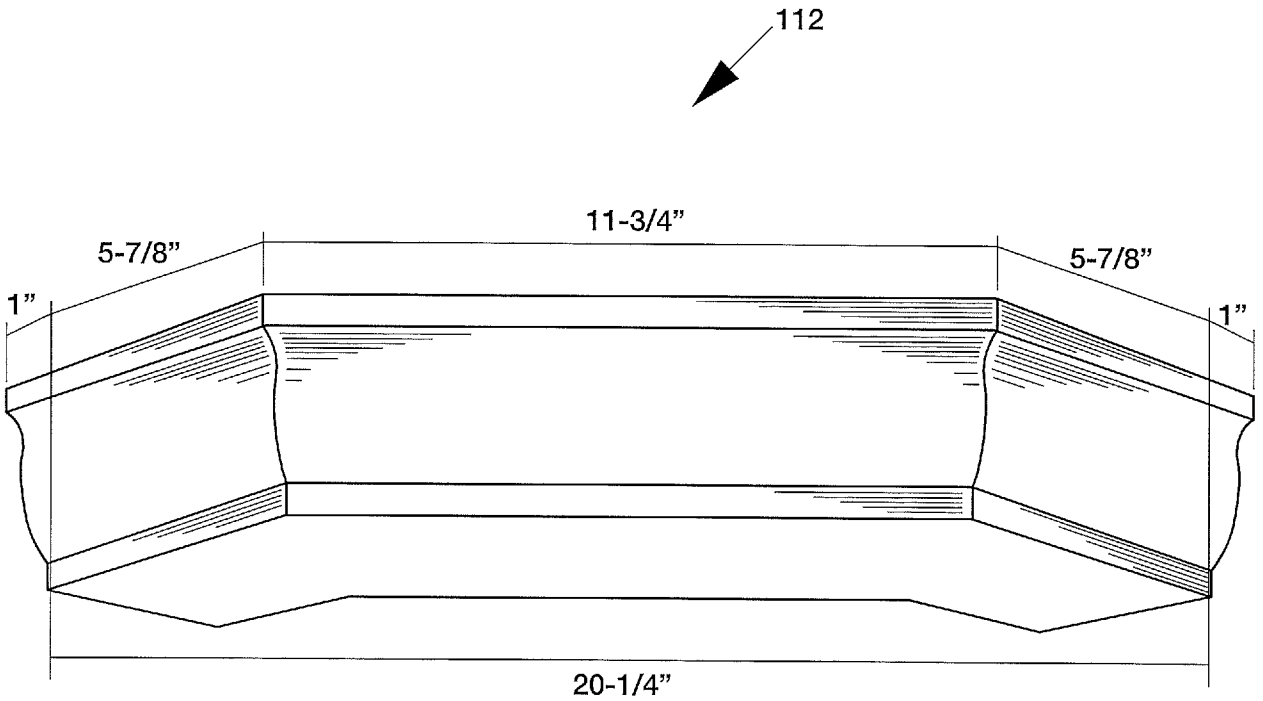
FIG. 8F is a back perspective view of one example of the linear gutter extension partial insert of FIG. 8.
Figure 9:
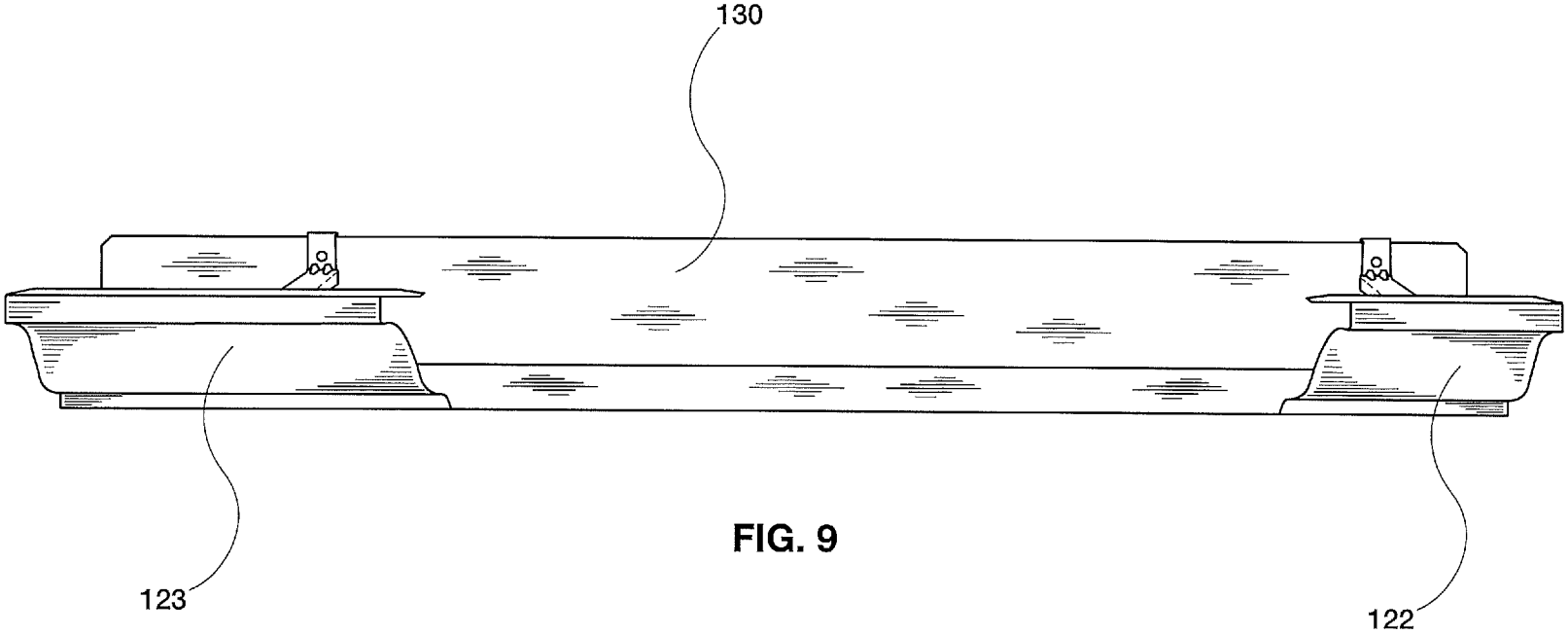
FIG. 9 shows a gutter system with a cut out for insertion of a linear gutter extension insert.

The gutter extension, in one example, may be a partial insert as seen in FIGS. 8-8D and fit into a gutter system cutout as shown in FIG. 9.

A gutter extension partial insert may include an extended face 112 as seen in one example in FIG. 8. The insert may include a first wall 114 having a corresponding bottom 114', a second wall 116 having a corresponding bottom 116', and a third wall 118 having a corresponding bottom 118'. Adjoining parts may be mitered together or made be constructed as one piece construction. Any suitable means for attaching the insert is considered within the scope of this disclosure and includes, by way of example, mitering, adhesion, and attachment with screws, latches, nails and/or bolts.

The water flow from a roof into the gutter is allowed to proceed more naturally (see W of FIGS. 1D and 7C) with the structure of the extension gutter of the present disclosure, especially opposed to hitting hard walls or corners that creates a stopping force instead of a circulating force moving the water through the gutters more directly and efficiently. Water flowing more naturally may also allow only a lip 24 for guiding the water and adjoining the extension to the gutter system and make unnecessary the addition of a water deflector. In other embodiments, a water deflector may be included. In some examples, the water deflector may provide an anchor location for roof attachments and/or for gutter attachments.

Gutter extension 10, 100 may be configured to fit with, for example, standard 5 inch and/or 6 inch gutter systems, and may also accommodate other sized gutter systems.

Dimensions enclosed in the specification and figures are exemplary and are not considered as limiting the inventions. Other dimensions are contemplated to be within the scope of this invention.

The ends of the gutter extension disclosed may be joined with a gutter system, in one example, by a miter seam, by bolts, clips, screws, nails, adhesive, by conventional gutter manufacturing techniques, etc. The parts of the gutter extension may be joined by miter seams and/or any other suitable means, for example, as suitable for joining a gutter extension with a gutter system.

The invention of the present disclosure may be considered a method for a gutter extension, a kit of a gutter extension, and/or a system for a gutter extension including any of the gutter extension embodiments as disclosed herein.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A gutter extension comprising:

a. a first gutter arm having a first back wall, a first gutter front wall an extension for attaching to a gutter system for a facility, the extension projecting away from a back wall, the extension configured to extend out further than the rest of the gutter system to which the extension attaches;

b. a second gutter arm, oriented substantially perpendicular to the first gutter arm, having a second back wall, a second gutter front wall, wherein the first back wall and the second back wall interface to form a back corner at least two extension front walls adjoining with a front gutter wall, and c. an extended face including a first front wall and a second front wall being substantially perpendicular to each other, the first front wall and second front wall of the extended face interfacing substantially perpendicularly to form a front corner, the front corner being diagonally opposed to the back corner and is the furthest point away from the back corner a bottom spanning between the back wall and the extension front walls, d. the first front wall of the extended face intersects substantially perpendicular with the first front gutter wall, and the second front wall of the extended face intersect substantially perpendicular with the second gutter front wall wherein an extended face projects outwardly away from the back wall, and wherein a first front wall of the at least two extension front walls and a second front wall of the at least two extension front walls interface to form a front corner, and said first front wall and said second front wall are substantially perpendicular to each other, and e. a bottom spanning between the first and second back walls, the gutter first and second front walls and the first and second front walls of the extended face, and wherein said gutter extension is an insert and forms a corner of a gutter system with said first front wall and said second front wall intersecting substantially perpendicularly with a first gutter arm and a second gutter arm, respectively, f. wherein the gutter extension is an insert and forms a corner of a gutter system.

2. The gutter extension of claim 1, wherein said front corner projects outward from said back corner by at least 10 inches.

3. The gutter extension of claim 1, wherein an area between said front corner and said back corner is at least double that of an area between a one of the front gutter walls and a the back corner of a gutter the back wall of the gutter system to which the extension attaches.

4. The gutter extension of claim 1, including an extension cover.

5. The gutter extension of claim 4, wherein said gutter extension is a box insert and the box insert is substantially square.

6. A gutter extension comprising:

a. an extension for attaching to a gutter system for a facility, the extension projecting away from a back wall having a first portion and second portion that intersects to form a back corner, the extension configured to extend out further than the rest of the gutter system to which the extension attaches;

b. the extension comprising at least two extension front walls each adjoining substantially perpendicular with a first and second front gutter wall, and c. a bottom spanning between the back wall and the at least two extension front walls, d. wherein an extended face projects outwardly away from a back wall and wherein said extension is a partial insert that creates an extended face with a substantially 90 degree angle forming a front corner between two adjoining portions of a gutter system.

7. A gutter extension comprising:

a. an extension comprising an extended face for attaching to a gutter system for a facility, the extension projecting away from a back wall located in one linear plane, the extension configured to extend out further than the rest of the gutter system to which the extension attaches;

b. at least two extension front walls adjoining with a front gutter wall, the extension having a first wall, a second wall and a third wall, the first wall intersecting substantially perpendicular with a first front gutter wall, the second wall intersecting substantially perpendicular with a second front gutter wall, wherein the first wall and second wall are substantially parallel to each other and separated by the third wall, wherein the third wall is substantially parallel with the back wall, and c. a bottom spanning between the back wall and the extension front first and second walls, d. wherein an the extended face projects outwardly away from a the back wall and wherein a third wall is substantially parallel with a back wall.

8. The gutter extension of claim 7, wherein said first wall and said second wall are non-parallel to the first and second front gutter walls said front wall and said back wall and said first and second front gutter front walls on each side of said extended face is are in the same linear plane.

9. The gutter extension of claim 8, wherein said first wall and said second wall extend outward from said linear plane and interface with said third wall to secure said third wall in a parallel but separate linear plane.

* * * * *